US008794738B2

(12) United States Patent
Katoh et al.

(10) Patent No.: US 8,794,738 B2
(45) Date of Patent: Aug. 5, 2014

(54) INKJET RECORDING APPARATUS AND METHOD FOR MAINTENANCE OF INKJET RECORDING APPARATUS

(75) Inventors: Satoshi Katoh, Miyagi (JP); Koji Nagai, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 130 days.

(21) Appl. No.: 12/965,253

(22) Filed: Dec. 10, 2010

(65) Prior Publication Data

US 2011/0148982 A1 Jun. 23, 2011

(30) Foreign Application Priority Data

Dec. 22, 2009 (JP) ..... 2009-291518
Jan. 28, 2010 (JP) ..... 2010-017331

(51) Int. Cl.
*B41J 2/165* (2006.01)

(52) U.S. Cl.
USPC ..... 347/29

(58) Field of Classification Search
None
See application file for complete search history.

(56) References Cited

U.S. PATENT DOCUMENTS

| | | | | |
|---|---|---|---|---|
| 5,483,267 | A | 1/1996 | Nemura et al. | |
| 5,896,143 | A * | 4/1999 | Matsui et al. | 347/24 |
| 5,903,287 | A | 5/1999 | Ishikawa et al. | |
| 6,880,913 | B2 * | 4/2005 | Suzuki | 347/23 |
| 2006/0170727 | A1 * | 8/2006 | Imazeki et al. | 347/33 |
| 2008/0291240 | A1 | 11/2008 | Ohsako et al. | |
| 2009/0046122 | A1 | 2/2009 | Inoue | |
| 2009/0058921 | A1 | 3/2009 | Habashi | |
| 2010/0245919 | A1 * | 9/2010 | Kanzaki | 358/1.17 |

FOREIGN PATENT DOCUMENTS

| | | |
|---|---|---|
| JP | 4-327947 | 11/1992 |
| JP | 9-70961 | 3/1997 |
| JP | 2771545 | 4/1998 |
| JP | 2001-113714 | 4/2001 |
| JP | 2001-260392 | 9/2001 |
| JP | 3231144 | 9/2001 |
| JP | 2004-223773 | 8/2004 |
| JP | 3670428 | 4/2005 |
| JP | 2006-96017 | 4/2006 |
| JP | 2008-213216 | 9/2008 |
| JP | 2008-290400 | 12/2008 |
| JP | 2008-307797 | 12/2008 |
| JP | 2009-18519 | 1/2009 |
| JP | 2009-45795 | 3/2009 |
| JP | 2009-78539 | 4/2009 |
| JP | 2009-166357 | 7/2009 |

OTHER PUBLICATIONS

Japanese official action dated Aug. 27, 2013 in corresponding Japanese patent application No. 2010-017331.
Japanese official action dated Oct. 8, 2013 in corresponding Japanese patent application No. 2009-291518.

* cited by examiner

*Primary Examiner* — Alejandro Valencia
(74) *Attorney, Agent, or Firm* — Cooper & Dunham LLP

(57) ABSTRACT

An image forming apparatus includes a recording head having a nozzle and configured to discharge droplets of a recording fluid via the nozzle onto a recording sheet in an image forming operation; a sheet transport unit configured to transport the recording sheet in a sheet transport direction; and a maintenance unit configured to perform a maintenance operation for the recording head. The maintenance unit is configured to be moved in a forward direction corresponding to the sheet transport direction and a backward direction opposite the forward direction. The maintenance unit performs the maintenance operation when the maintenance unit is moved in the backward direction.

12 Claims, 28 Drawing Sheets

INKJET RECORDING APPARATUS AND METHOD FOR MAINTENANCE OF INKJET RECORDING APPARATUS

BACKGROUND OF THE INVENTION

1. Field of the Invention

The present invention relates to an inkjet image forming apparatus in which a head maintenance operation is performed, and to a head maintenance method.

2. Description of the Related Art

An inkjet image forming apparatus, such as an inkjet printer, has a recording head configured to discharge droplets of a recording fluid, such as ink, via a plurality of small nozzles onto a recording medium, such as a sheet of paper. For discharging the droplets, the recording head may employ various mechanisms, such as a movable actuator mechanism based on a piezoelectric principle, or a thermal mechanism based on film boiling (see Patent Documents 1 through 5, for example).

In such an inkjet image forming apparatus, a maintenance operation is performed as required in order to maintain or recover a proper ink discharging performance of the nozzles in the recording head. The maintenance operation may include capping and recovery. Capping involves capping the nozzles of a recording head with a cap in a non-activated period of the head in order to prevent the clogging of the nozzles due to the drying of the recording fluid, which may result in a decrease in the discharged amount of recording fluid. Recovery includes a blank discharge operation and a "flow-out" operation. In the blank discharge operation, the recording head discharges ink into the cap in a period other than an image formation period. In the flow-out operation, the ink is suctioned out of the nozzles of the recording head into the cap using a vacuum pump, for example.

Although the recovery operation requires a mechanism for ejecting the recording fluid collected in the cap out of the cap, the mechanism is not very complex when there is only one head and one cap. However, when there are multiple heads and the corresponding caps, each cap requires the ink ejecting mechanism so as to eject the ink out of the cap (see Patent Documents 2 and 3), resulting in a more complex structure and an increase in cost.

A conventional technology attempts to overcome the above problem by providing the ink ejecting mechanism to only one of the caps and making the one cap movable so that the movable cap can be moved to whichever recording head is used for blank discharge, and the ink can be discharged into the movable cap. Another technology proposes performing the recovery operation for multiple recording head units successively by moving a cap in one direction (see Patent Document 5, for example).

However, when the recovery operation is successively performed by moving the cap, the standby time between the end of the recovery operation and the start of the next image forming operation varies depending on the position of the recording head. For example, the standby time is longer for the recording head for which the recovery operation is performed first than for the recording head for which the recovery operation is performed last. As a result, the viscosity of the ink in the first recording head may increase to such an extent that the required level of ink discharge performance may not be maintained for the next image forming operation.

Further, the blank discharge operation is associated with the problem of staining of areas around the recording head that has performed blank discharge, such as the nozzles of an adjacent recording head.

Patent Document 6 discloses that two ink receiving units for receiving ink discharged in a preliminary discharge operation are provided at different locations, and one of the ink receiving units is selected depending on the location of the preliminary discharge operation in order to prevent the staining of the interior of the image forming apparatus by the discharged ink. Patent Document 7 discloses that a blocking member is provided for preventing the staining of areas around the recording head by an ink mist produced by the blank discharge operation. Patent Document 8 discloses that a suction recovery operation is performed only for one or more of the recording head units in which an ink discharge defect is present, wherein a separate cap member for the recovery operation is provided.

Patent Document 9 discloses a positioning mechanism for positioning a maintenance unit. Patent Document 10 discloses that the caps are divided into two or more groups, where some of the nozzles can be independently closed by one of the cap groups or all of the caps can be closed by all of the nozzles simultaneously. Patent Document 11 discloses that a blank discharge operation can be performed for a recording head positioned in an area outside the range of the recording sheet by using a movable cap member. Patent Document 12 discloses a structure that enables maintenance of a recording head having a number of nozzles, where ink is suctioned out of the nozzles in a uniform manner.

While the above conventional technologies enable recovery of plural recording head units independently by pressure discharge, suctioning, or blank discharge, none of the technologies address the problem of staining of the recording head adjacent the recording head used for blank discharge by the ink mist produced by the blank discharge and released upon removal of the cap, for example.

Patent Document 1: JP9-70961A
Patent Document 2: JP2009-78539A
Patent Document 3: JP Patent No. 3231144
Patent Document 4: JP2008-290400A
Patent Document 5: JP Patent No. 3670428
Patent Document 6: JP2001-113714A
Patent Document 7: JP2008-307797A
Patent Document 8: JP2006-96017A
Patent Document 10: JP2009-166357A
Patent Document 11: JP Patent No. 2771545
Patent Document 12: JP2008-213216A

SUMMARY OF THE INVENTION

In one aspect, the invention provides an image forming apparatus that includes a recording head having a nozzle and configured to discharge droplets of a recording fluid via the nozzle onto a recording sheet in an image forming operation; a sheet transport unit configured to transport the recording sheet in a sheet transport direction; and a maintenance unit configured to perform a maintenance operation for the recording head. The maintenance unit is configured to be moved in a forward direction corresponding to the sheet transport direction and a backward direction opposite the forward direction. The maintenance unit performs the maintenance operation when the maintenance unit is moved in the backward direction.

In another aspect, the invention provides an image forming apparatus that includes a plurality of recording heads each having a plurality of nozzles and configured to discharge droplets of a recording fluid via the nozzles onto a recording sheet in order to form an image on the recording sheet in an image forming operation; and a maintenance unit including a plurality of capping units that are independently movable along a recording sheet transport direction and capable of capping the nozzles of the recording heads individually. The maintenance unit performs a blank discharge operation in a maintenance period in order to recover a required ink discharge performance of the recording heads, the blank discharge operation involving causing the recording heads to discharge the droplets of the recording fluid via the nozzles. During the blank discharge operation for one of the recording heads, the nozzles of another recording head are capped by one of the capping units.

In another aspect, the invention provides a method of controlling an image forming apparatus comprising a plurality of recording heads each having a plurality of nozzles and configured to discharge droplets of a recording fluid via the nozzles onto a recording sheet in order to form an image on the recording sheet in an image forming operation; and a maintenance unit including a plurality of capping units that are independently movable along a recording sheet transport direction and capable of capping the nozzles of the recording heads individually. The method includes causing one of the recording heads to discharge the droplets of the recording fluid via the nozzles in a blank discharge operation; and capping the nozzles of another recording head by one of the capping units during the blank discharge operation for the one recording head.

DETAILED DESCRIPTION OF THE PREFERRED EMBODIMENTS

Reduction of Stand-by Time

Figure 1:
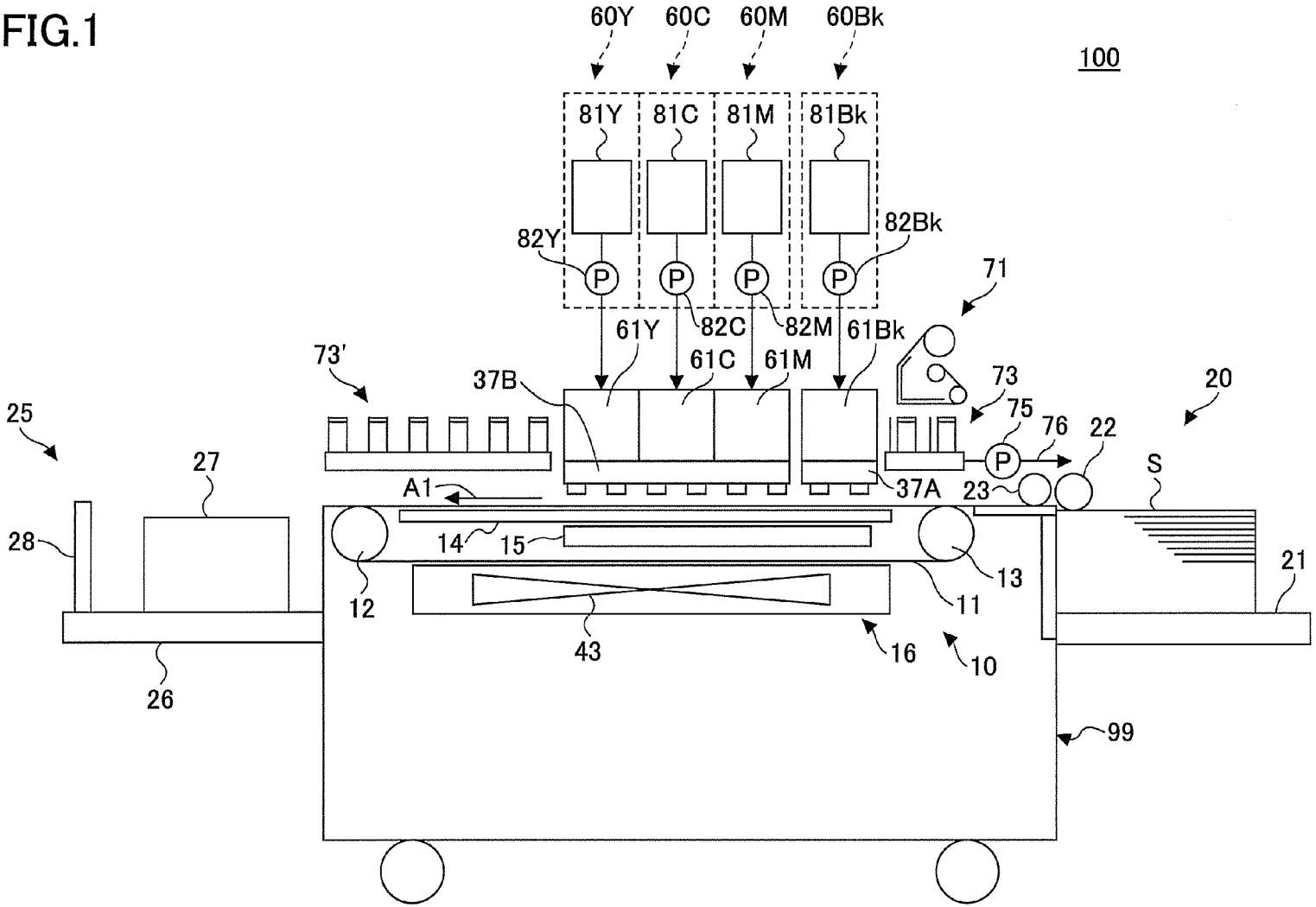
FIG. 1 illustrates an image forming apparatus according to an embodiment of the present invention.

FIG. 1 illustrates a full-color inkjet printer 100 (image forming apparatus) according to an embodiment of the present invention. The inkjet printer 100 performs an image formation (printing) process in accordance with an external image signal corresponding to image information. Specifically, the inkjet printer 100 forms an image on a sheet S of recording material, such as paper. The sheet S may include an OHP sheet, cards, and envelopes. The inkjet printer 100 may be configured to form an image on one or both sides of the sheet S.

The inkjet printer 100 includes a recording head unit 61Bk for discharging droplets of black ink (recording fluid). The black recording head unit 61Bk is supported on a carriage 37A. The inkjet printer 100 also includes color recording head units 61M, 61C, and 61Y for discharging ink droplets of the various colors of magenta (M), cyan (C), and yellow (Y), respectively. The color recording head units 61M, 61C, and 61Y are supported on a carriage 37B. The black recording head unit 61Bk includes a group Bk of nozzles (see FIG. 2). The color recording head units 61M, 61C, and 61Y have groups C1, C2, and C3 of nozzles, respectively, for the corresponding colors.

The recording head units 61Bk, 61M, 61C, and 61Y are disposed above a transport unit 10 for transporting the sheet S in a sheet transport direction indicated by an arrow A1, which is toward the left in the drawing. Thus, the inkjet printer 100 is of a tandem structure, in which the recording head units 61Bk, 61M, 61C, and 61Y are arranged opposite the sheet transport path and along the sheet transport direction A1.

The recording head units 61Bk, 61M, 61C, and 61Y are connected to ink discharge units 60BK, 60M, 60C, and 60Y, respectively. In a color recording operation, the recording head units 61Bk, 61M, 61C, and 61Y discharge the droplets of ink of the various colors onto the sheet S that is transported by the transport unit 10, such that the various colors of ink are successively laid over one another, thereby forming a desired color image on the sheet S. The inkjet printer 100 further includes a sheet-feeding unit 20 and an ejected-sheet receiver 25 for receiving the sheet S after the image forming process.

The inkjet printer 100 further includes a capping/recovery unit 73 and a capping unit 73'. The capping/recovery unit 73 is used for capping the recording head unit 61Bk during a non-activated period of the recording head unit 61Bk in order to maintain the recording head unit 61Bk in a proper wet condition. The capping/recovery unit 73 is also used for recovering a required ink discharge performance of the black head unit 61Bk and the color head units 61M, 61C, and 61Y. Thus, the capping/recovery unit 73 functions both as a capping unit and a recovery unit. The capping unit 73' is configured to cap the color head units 61M, 61C, and 61Y for maintenance purposes. The inkjet printer 100 also includes a cleaner unit 71 for cleaning the capping/recovery unit 73.

Figure 2:
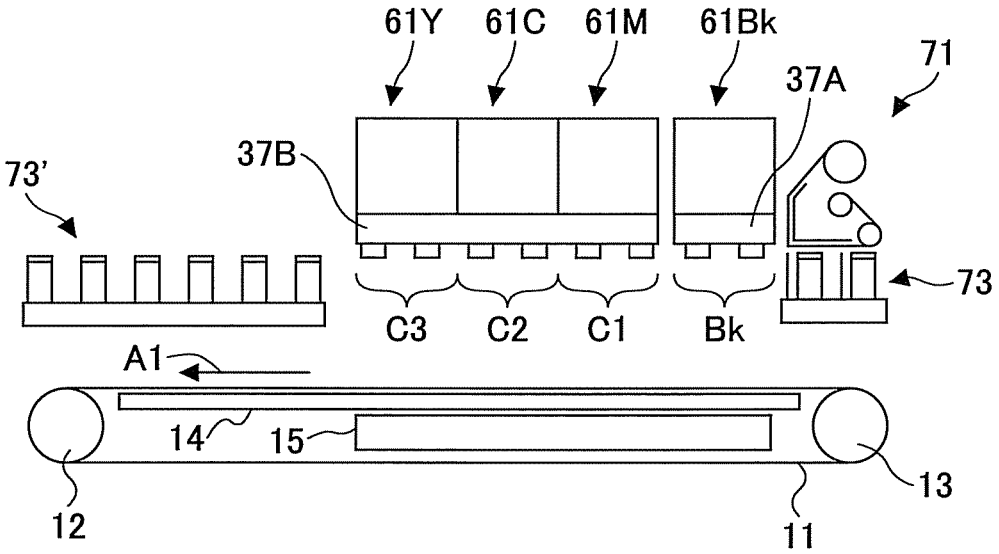
FIG. 2 illustrates a main portion of the image forming apparatus of FIG. 1 including an image forming unit (recording head units), a sheet transport unit (belt), and a maintenance unit (caps) of the image forming apparatus, where all of the recording head units are in separated positions.

The inkjet printer 100 also includes a head moving mechanism (not shown) for moving the carriages 37A and 37B vertically independently between a recording position and a separated position, as will be described later. In the recording position, the carriage 37A or 37B is at a lowered position so that the corresponding recording head units are close to the transport unit 10, as illustrated in FIG. 1, where the recording head units may discharge ink droplets for a print (image forming) operation. In the separated position, the carriage 37A or 37B is at a raised position so that the corresponding recording head units are spaced apart from the transport unit 10, as illustrated in FIG. 2. The head moving mechanism includes a head moving motor 42 (see FIG. 3). In the separated position, a maintenance or recovery operation may be performed for the recording head units 61Bk, 61M, 61C, and 61Y.

Figure 3:
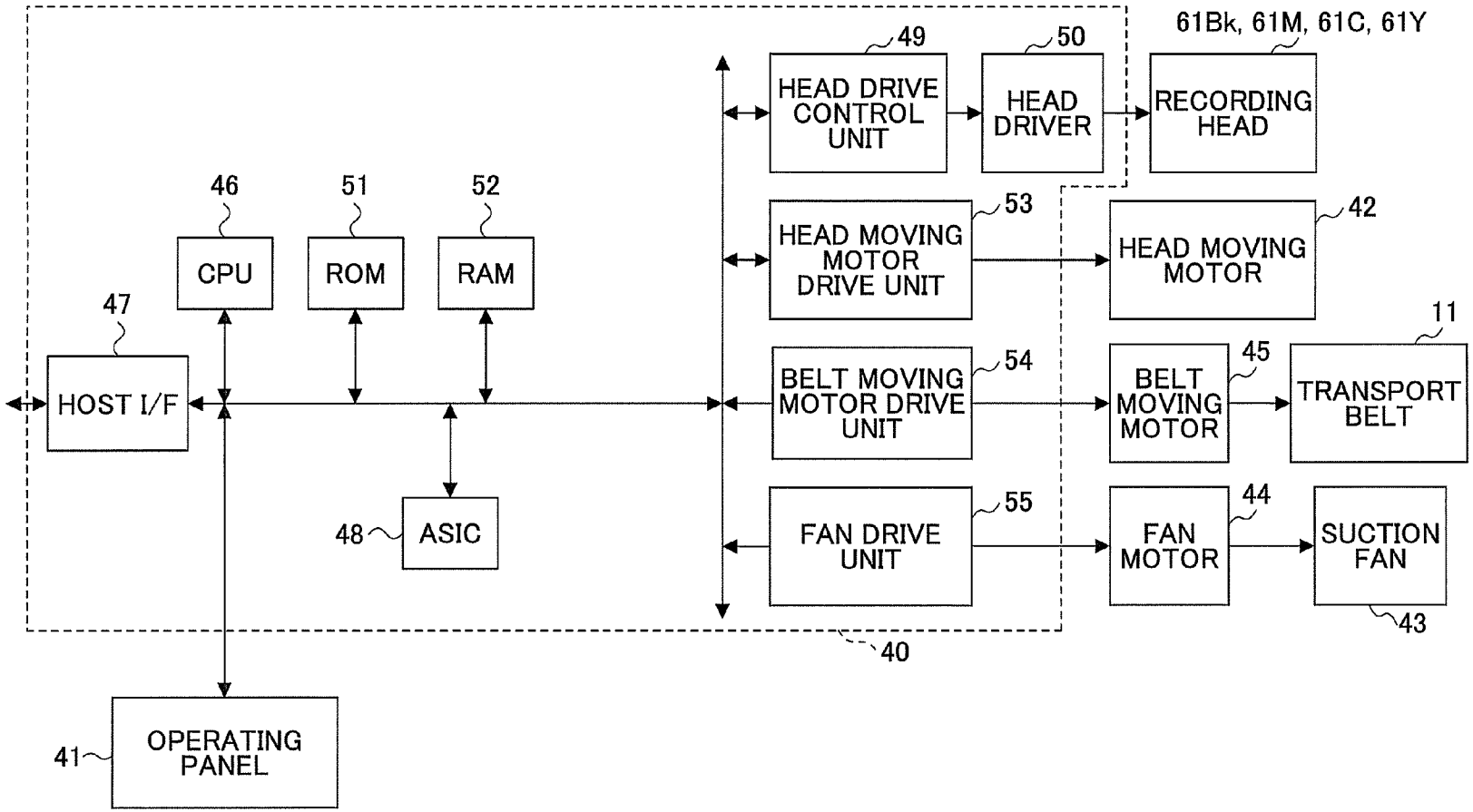
FIG. 3 is a block diagram of the image forming apparatus.

FIG. 3 is a block diagram of the inkjet printer 100. The inkjet printer 100 includes a control unit 40 and an operating panel 41. The control unit 40 includes a CPU (central processing unit) 46 for controlling the overall operation of the printer, a ROM (read-only memory) 51, and a RAM (random access memory) 52. The operating panel 41 may be used for entering an operation setting of the inkjet printer 100.

Figure 4:
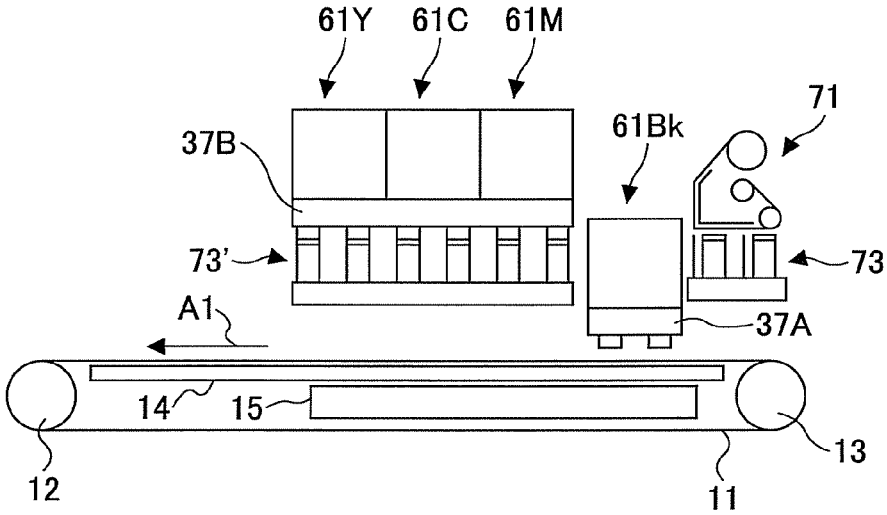
FIG. 4 illustrates the main portion of the image forming apparatus in which the recording head unit for black is in a recording position.

During a color image formation process, both the carriages 37A and 37B are lowered so that all of the recording head units 61Bk, 61M, 61C, and 61Y are in the recording position close to the transport unit 10. On the other hand, during a monochrome image formation process, i.e., black image formation, only the carriage 37A is lowered such that only the recording head unit 61Bk is in the recording position close to the transport unit 10, as illustrated in FIG. 4. In this case, the color recording head units 61M, 61C, and 61Y are capped by the capping unit 73'.

Figure 5:
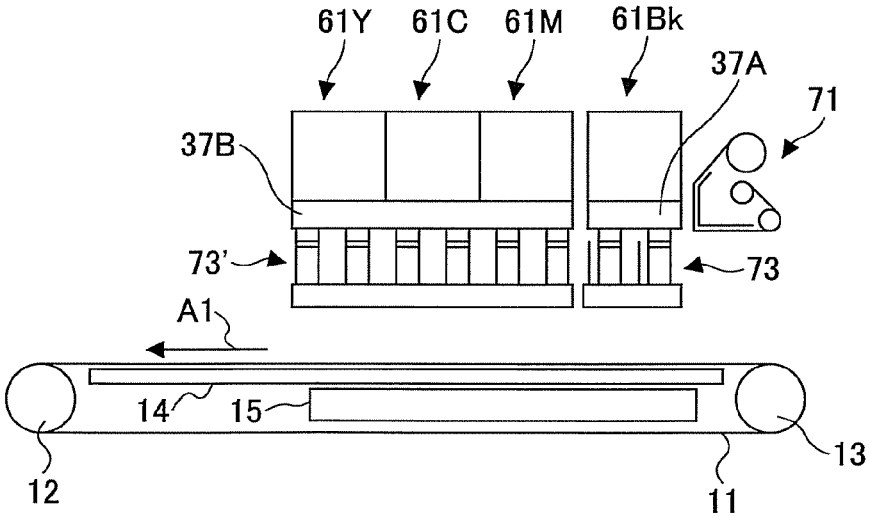
FIG. 5 illustrates the main portion in which the caps of all of the recording head units are capped by the capping units.
Figure 6A:
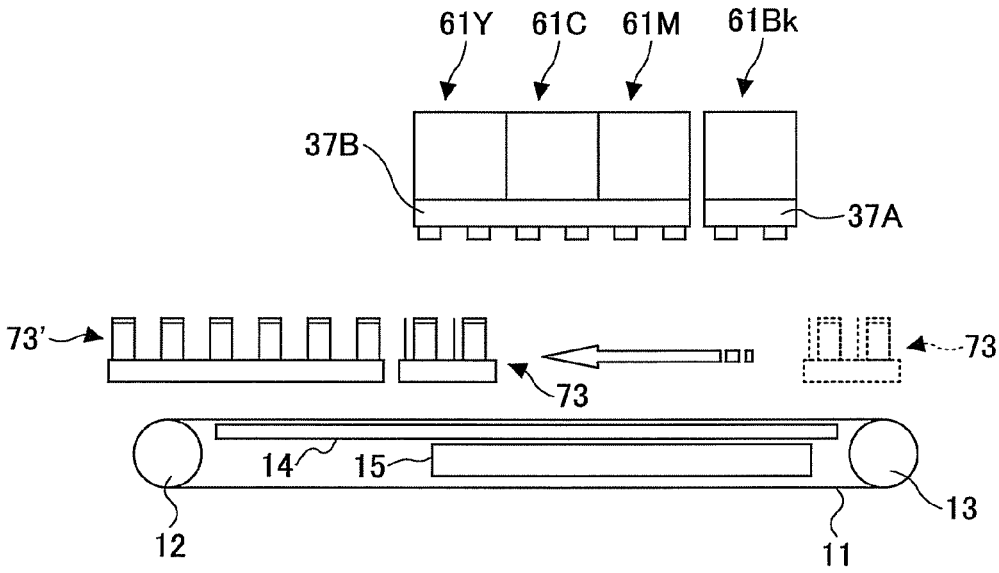
FIG. 6A illustrates the main portion illustrating the movement of a capping/recovery unit in a forward movement of a maintenance operation.
Figure 6B:
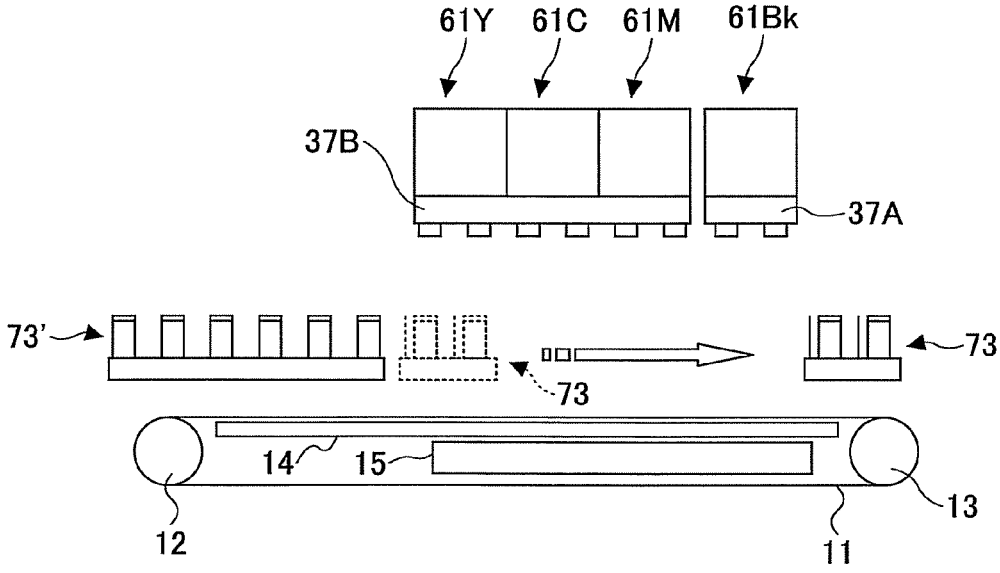
FIG. 6B illustrates the movement of the capping/recovery unit in a backward movement of the maintenance operation.

When both the carriages 37A and 37B are moved upward so that all of the recording head units 61Bk, 61M, 61C, and 61Y are in the separated position, the recording head unit 61Bk may be capped by the capping/recovery unit 73 while the color recording head units 61M, 61C, and 61Y may be capped by the capping unit 73' as illustrated in FIG. 5. Alternatively, when all of the recording heads are in the separated position as illustrated in FIGS. 6A and 6B, the capping/recovery unit 73 may be moved back and forth along the sheet transport direction in an area opposite the recording head units 61Bk, 61M, 61C, and 61Y without capping the recording head units 61M, 61C, and 61Y with the capping unit 73' in a recovery operation, as will be described in detail later.

Referring back to FIG. 1, the transport unit 10 includes an endless transport belt 11 configured to rotate in the sheet transport direction A1; a drive roller 12 and a driven roller 13 across which the transport belt 11 is extended; a back side support member 14 disposed on a back side of the transport belt 11 in an area opposite the recording head units 61Bk, 61M, 61C, and 61Y; an ink receiver 15 disposed under the back side support member 14; a suction unit 16 disposed under the transport belt 11 for causing the sheet S to be suctioned onto the transport belt 11; and a transport belt motor 45 (see FIG. 3) for driving the drive roller 12.

The transport belt 11 has a number of openings (not shown) for allowing the ink (recording fluid) to pass through and be collected in the ink receiver 15 during a preliminary discharge operation, as will be described later. The suction unit 16 includes a suction fan 43 for producing a negative pressure and a suction fan motor 44 (see FIG. 3) for rotating the suction fan 43. The suction unit 16 is configured to cause the sheet S to be held on the transport belt 11 using the negative pressure via the openings in the transport belt 11. Thus, the openings in the transport belt 11 are used for sheet suctioning and ink collecting purposes.

The back side support member 14 supports the transport belt 11 from below so that the transport belt 11 does not dangle due to the negative pressure produced by the suction fan 16. The back side support member 14 is configured to allow the ink discharged onto the transport belt 11 during the preliminary discharge operation or image forming process to reach the ink receiver 15. The transport unit 10 may include a fusing unit (not shown) for causing an image formed on the sheet S by an image forming process to be fused onto the sheet S.

The sheet-feeding unit 20 includes a sheet-feeding tray 21 in which a number of the sheets S can be mounted, a separating roller 22 for engaging the upper-most one of the sheets S in the sheet-feeding tray 21, a feeding roller 23 for feeding the sheet S picked up by the separating roller 22 onto the transport unit 10, and a drive unit, such as a motor (not shown) for rotating the feeding roller 23 such that the sheet S can be fed at proper timing with respect to the discharging of ink droplets from the recording head units 61Bk, 61M, 61C, and 61Y. The ejected-sheet receiver 25 includes an ejected-sheet tray 26 capable of storing a number of the printed sheets S, a pair of side fences 27 for regulating the sheets S in a width-direction of the sheet S, and an end fence 28 for regulating the front end of the sheets S, which is to the left of the drawing.

The carriages 37A and 37B may be detachable from the main body 99 together with the recording head units 61Bk, 61M, 61C, and 61Y so that these heads can be replaced with new ones, or for maintenance purposes. The recording head units 61Bk, 61M, 61C, and 61Y may also be independently detachable from the corresponding carriage 37A or 37B so that they can be replaced with new ones or for maintenance purposes.

The ink discharge units 60BK, 60M, 60C, and 60Y are substantially identical in structure. The ink discharge units 60BK, 60M, 60C, and 60Y are connected to the recording head units 61Bk, 61M, 61C, and 61Y, respectively, each of which extends in a main-scan direction (corresponding to the width of the sheet P) perpendicular to the sheet transport direction A1, i.e., a sub-scan direction. Each of the recording head units 61Bk, 61M, 61C, and 61Y has one or more rows of nozzles (not shown) extending in the main-scan direction. Thus, the inkjet printer 100 is a fixed-head, line-type inkjet recording apparatus. The nozzles of the recording head units may be arranged in a staggered manner in the main-scan direction.

The ink discharge units 60BK, 60M, 60C, and 60Y include an ink supply system having ink cartridges 81BK, 81M, 81C, and 81Y; pumps 82BK, 82M, 82C, and 82Y; and distributor tanks (not shown), respectively. The ink cartridges 81BK, 81M, 81C and 81Y may be referred to as main tanks, storing the various colors of ink supplied to the recording head units 61Bk, 61M, 61C, and 61Y. The pumps 82BK, 82M, 82C, and 82Y are used for pumping the ink from the ink cartridges 81BK, 81M, 81C, and 81Y to the recording head units 61Bk, 61M, 61C, and 61Y, respectively. The distributor tanks (not shown), which may be referred to as sub-tanks, may be disposed between the pumps 82BK, 82M, 82C, and 82Y and the recording head units 61Bk, 61M, 61C, and 61Y, respectively.

The ink cartridges 81BK, 81M, 81C, and 81Y may be detachable from the main body 99 so that they can be replaced with new ones when there is too little ink in the cartridges, or for maintenance purposes. The pumps 82BK, 82M, 82C, and 82Y may be controlled by the control unit 40 so that they can be activated upon detection of a lack of ink in the distributor tanks by an ink amount detection sensor. The pumps may be kept activated to supply the ink from the ink cartridges 81BK, 81M, 81C, and 81Y to the distributor tanks until no lack of ink is detected. The control unit 40 may be configured to control other units or components of the inkjet printer 100.

While not illustrated, each of the recording head units 61Bk, 61M, 61C, and 61Y includes a nozzle plate disposed on an ink discharge side of the head unit. The nozzle plate has nozzles directed downward with reference to FIG. 1, for example. Each recording head unit also includes an ink chamber filled with the ink supplied from the distributor tank, and an actuator for causing the ink in the ink chamber to be discharged via the nozzles.

The actuator may include a piezoelectric element for causing the ink to be discharged out of the nozzles in the form of droplets onto the sheet S. The piezoelectric element may be activated by a voltage pulse. The actuator may be based on other mechanisms, such as a thermal mechanism using a heater or the like. The ink (recording fluid) may include a water-pigment ink containing a colorant of the corresponding color, a dispersant, and a solvent. The main body 99 may include a front plate, a back plate, side plates, and a stay, which are not illustrated.

Figure 7:
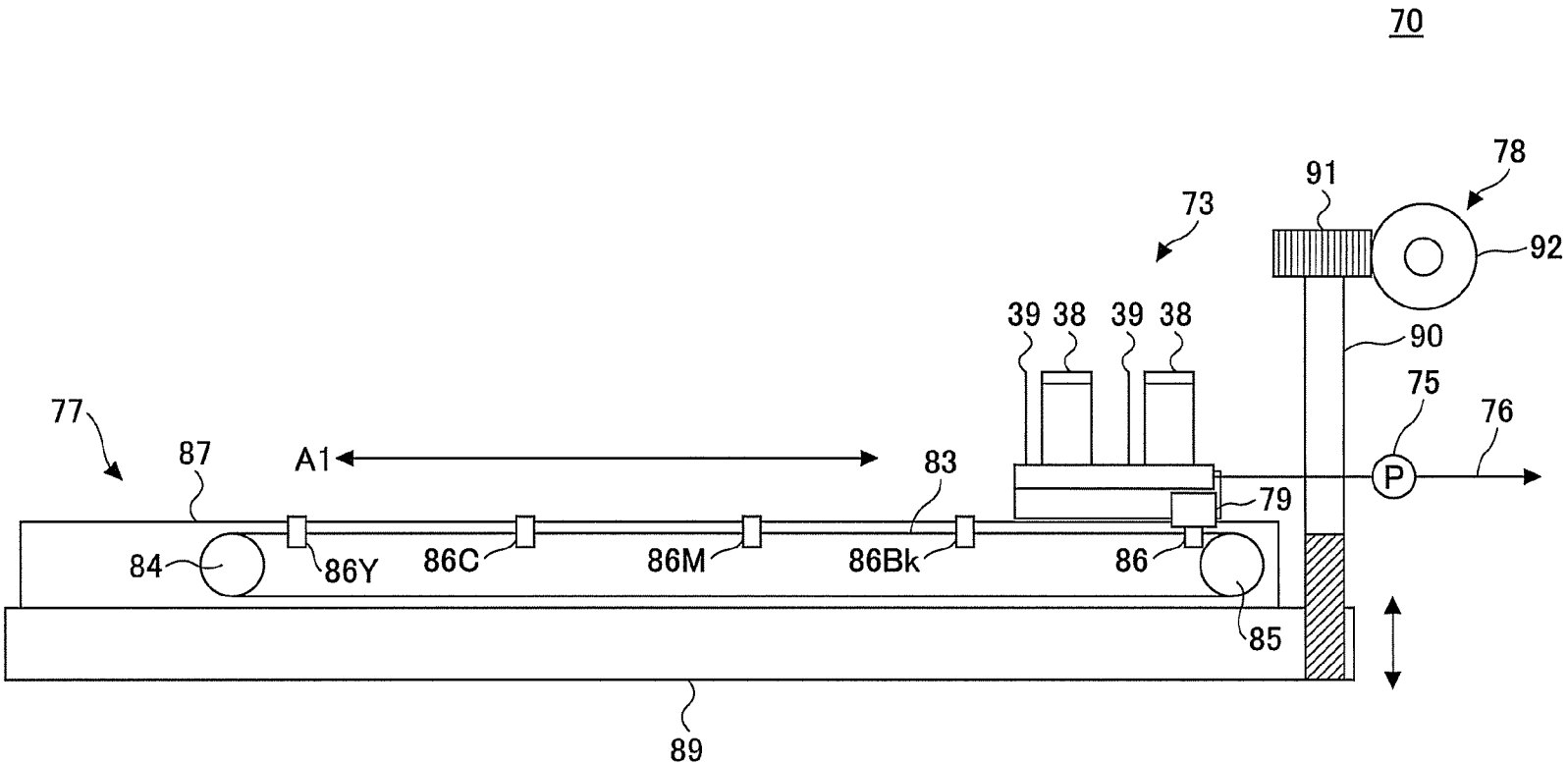
FIG. 7 illustrates a cap moving mechanism for the capping/recovery unit.

FIG. 7 illustrates a cap moving mechanism 70 for the capping/recovery unit 73. The cap moving mechanism 70 includes a horizontal cap moving unit 77 and a vertical cap moving unit 78. The capping/recovery unit 73 is disposed on the horizontal cap moving unit 77. The capping/recovery unit 73 includes caps 38 with which the nozzles of the recording head units 61Bk, 61M, 61C, and 61Y can be selectively capped when the head units are in the separated position. The capping/recovery unit 73 also includes wipers 39 configured to clean the recording head units 61Bk, 61M, 61C, and 61Y in the separated position by wiping ink off the nozzles of the recording head units 61Bk, 61M, 61C, and 61Y. During a blank discharge operation, the recording head units 61Bk, 61M, 61C, and 61Y discharge ink droplets with the nozzles capped by the caps 38.

The horizontal cap moving unit 77 is configured to move the capping/recovery unit 73 horizontally, i.e., along the sheet transport direction A1. The vertical cap moving unit 78 is configured to move the capping/recovery unit 73 vertically to a capping position such that the caps 38 can be engaged with the nozzles of the recording head units 61Bk, 61M, 61C, and 61Y in the separated position for a capping or recovery operation. The capping/recovery unit 73 also includes a pump 75 for suctioning the ink out of the recording head units 61Bk, 61M, 61C, and 61Y for a flow-out operation. The caps 38 and the pump 75 are coupled via an ejection channel 76 for ejecting the ink in a recording fluid storage unit (not shown) connected to the ejection channel 76.

In accordance with the present embodiment, the caps 38 of the capping/recovery unit 73 may be used as a blank discharge receiver into which the ink is discharged during a blank discharge operation. Alternatively, the capping/recovery unit 73 may include a separate blank discharge receiver for receiving the ink discharged by the blank discharge operation.

The horizontal cap moving unit 77 includes a fixing member 79 by which the capping/recovery unit 73 is fixed to an endless belt 83, and a drive pulley 84 and a driven pulley 85 across which the belt 83 is wound. The horizontal cap moving unit 77 also includes sensors 86BK, 86M, 86C, and 86Y disposed at positions corresponding to the recording head unit 61Bk, 61M, 61C, and 61Y for detecting when the caps 38 are positioned opposite the recording head units 61Bk, 61M, 61C, and 61Y, respectively, by detecting the fixing member 79. The horizontal cap moving unit 77 also includes a sensor 86 for detecting when the caps 38 are located at a home position where the caps 38 are opposite none of the recording head units 61Bk, 61M, 61C, and 61Y. The horizontal cap moving unit 77 further includes a support base 87 supporting the capping/recovery unit 73 from below, and a drive unit, such as a motor (not shown) for driving the drive pulley 84. The vertical cap moving unit 78 includes a base member 89 on which the support base 87 is disposed, and a drive shaft 90 of which a lower-end portion is in threaded engagement with the base member 89. A gear 91 is fixed to the other end of the shaft 90 and engaged with a gear 92 which is rotated by a drive unit, such as a stepping motor (not shown).

Thus, the capping/recovery unit 73 can be moved back and forth horizontally as described above by the horizontal cap moving unit 77, and can be accurately positioned opposite any one of the recording head units 61Bk, 61M, 61C, and 61Y in the separated position, or in the home position based on the detection of the fixing member 79 by the sensors 86BK, 86M, 86C, 86Y, and 86. After the capping/recovery unit 73 is positioned opposite one of the recording head units 61Bk, 61M, 61C, and 61Y by the horizontal cap moving unit 77, the capping/recovery unit 73 can be moved upward by the vertical cap moving unit 78 by a predetermined amount (which may be a predetermined number of pulses in the case of a stepping motor), thus engaging the caps 38 with the nozzles of the corresponding recording head units in the separated position. The vertical position of the caps 38 may be detected by a combination of a motor and a sensor instead of the stepping motor.

Figure 8:
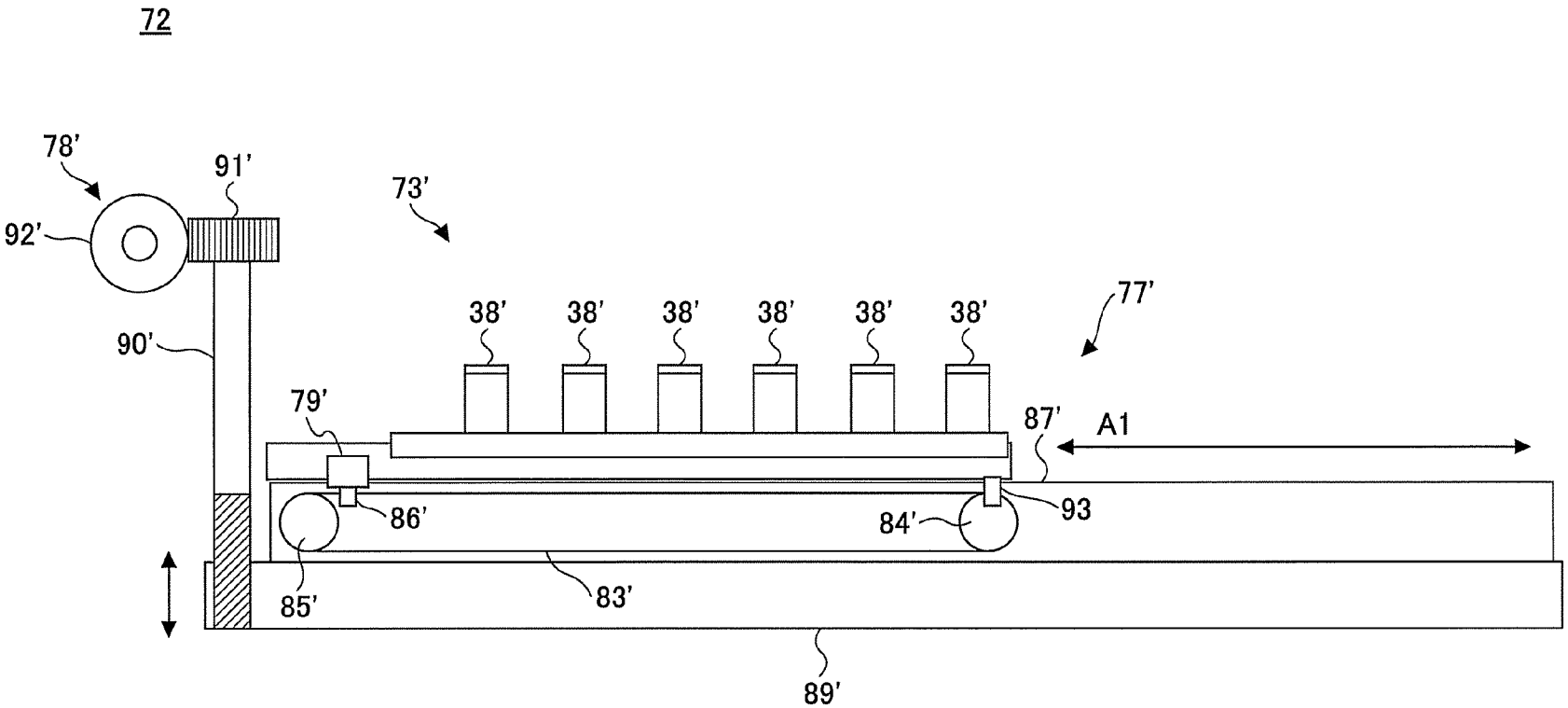
FIG. 8 illustrates a cap moving mechanism for a capping unit.

FIG. 8 illustrates a cap moving mechanism 72 for the capping unit 73'. The cap moving mechanism 72 is similar in structure to the cap moving mechanism 70 for the capping/recovery unit 73. Thus, the parts of the cap moving mechanism 72 similar to the parts of the cap moving mechanism 70 are designated with similar numerals with a prime "'", and the description of their operation is omitted whenever appropriate.

The cap moving mechanism 72 includes a horizontal cap moving mechanism 77' and a vertical cap moving mechanism 78'. The capping unit 73' is disposed on the horizontal cap moving mechanism 77'. The capping unit 73' includes color caps 38' configured to cap the nozzles of the color recording head units 61M, 61C, and 61Y in the separated position during a non-activated period. The capping unit 73' is not configured to cap the recording head unit 61Bk. The horizontal position of the capping unit 73' is detected by sensors 86' and 93.

Thus, the capping unit 73' can be moved back and forth horizontally by the horizontal cap moving unit 77'. The caps 38' can be accurately positioned opposite the recording head units 61M, 61C, and 61Y in the separated position, or in the home position where the caps 38' are opposite none of the recording head units, based on the detection of the fixing member 79' by the sensors 86' and 93. After the caps 38' are positioned opposite any of the recording head units 61M, 61C, and 61Y in the separated position by the horizontal cap moving unit 77', the caps 38' can be moved upward by a predetermined amount by the vertical cap moving unit 78', thus engaging the caps 38' with the recording head units 61M, 61C, and/or 61Y in a capping position. The vertical position of the caps 38' may be detected by a combination of a motor and a sensor instead of a stepping motor.

The cleaning unit 71 (see FIG. 1) may clean the caps 38 and the wipers 39 of capping/recovery unit 73 in the home position for maintenance. The cleaning of the capping/recovery unit 73 by the cleaning unit 71 may be performed at regular intervals, such as after a predetermined number of sheets have been printed.

Referring to FIG. 3, during an image formation (printing) operation, the CPU 46 of the control unit 40 reads print data from a reception buffer in the host I/F 47, analyzes the data, and then transfers the image data to a head drive control unit 49. Before the transfer, the image data may be processed by an ASIC 48 by rearranging the data or performing a part of an image process. The print data transferred to the control unit 40 may include bitmap data, i.e., print raster data for image output, obtained by converting image data by a printer driver on the host end. The head drive control unit 49 outputs the print data (bit map data or raster data) to a head driver 50 as serial data in synchronism with a clock signal, while outputting a latch signal to the head driver 50 at a predetermined timing. The head drive control unit 49 may include a memory (such as a dedicated ROM) storing pattern data of a drive signal (drive waveform), a waveform generating circuit including a D/A converter for D/A conversion of the drive waveform data read from the ROM 51, and a drive waveform generating circuit which may include an amplifier.

The head driver 50 may include a shift register for the input of the serial data (clock signal and image data) from the head drive control unit 49, a latch circuit for latching a register value in the shift register using a latch signal from the head drive control unit 49, a level shifter (level conversion circuit) for changing the level of an output value of the latch circuit, and a switch unit which may include an analog switch array that is turned on or off by the level shifter. By controlling the on- and off-state of the analog switch array, an appropriate drive waveform can be selectively applied to the recording head units 61Bk, 61M, 61C, and 61Y. Thus, the recording head units 61Bk, 61M, 61C, and 61Y can be selectively driven to discharge ink droplets onto the sheet S (recording medium), forming a dot pattern in accordance with the image data.

The ROM 51 in the control unit 40 may store a control sequence table associating the amount of ink discharged during the blank discharge operation with the length of time in which the recording head units 61Bk, 61M, 61C, and 61Y are in a standby position and the ambient temperature and/or humidity. The control unit 40 also includes a head moving motor drive unit 53 for driving the head moving motor 42, a transport belt drive unit 54 for driving the transport belt motor 45, and a fan drive unit 55 for driving the suction fan motor 44.

When a monochrome image is formed in the inkjet printer 100, in response to a signal indicating the start of a monochrome image formation process, the head unit 61Bk is lowered to the printing position as illustrated in FIG. 4, and the sheet S is fed out of the sheet-feeding unit 20 and then transported by the transport unit 10. During the transport of the sheet S, the recording head unit 61Bk discharges droplets of black ink onto a predetermined position of the sheet S, thus forming a monochrome image on the sheet S. The sheet S with the monochrome image is further transported by the transport unit 10 and eventually ejected onto the ejected-sheet receiver 25.

When a color image is formed in the inkjet printer 100, in response to a signal indicating the start of a color image formation process, the sheet S is fed out of the sheet-feeding unit 20 and transported by the transport unit 10. During the transport of the sheet S, the recording head units 61Bk, 61M, 61C, and 61Y discharge ink droplets of the various colors onto the sheet S at appropriate timing in the recording position illustrated in FIG. 1, for example, such that dot patterns of the various colors are superposed on the same position on the sheet S as the sheet is transported in the sheet transport direction A1. The sheet S with the color image is further transported by the transport unit 10 and eventually ejected onto the ejected-sheet receiver 25.

After the monochrome or color image formation process, the recording head unit 61Bk is capped by the capping/recovery unit 73 so that the head can be maintained in a proper wet state, while the color recording head units 61M, 61C, and 61Y are capped by the capping unit 73' so that they can be maintained in a proper wet condition.

Figure 9A:
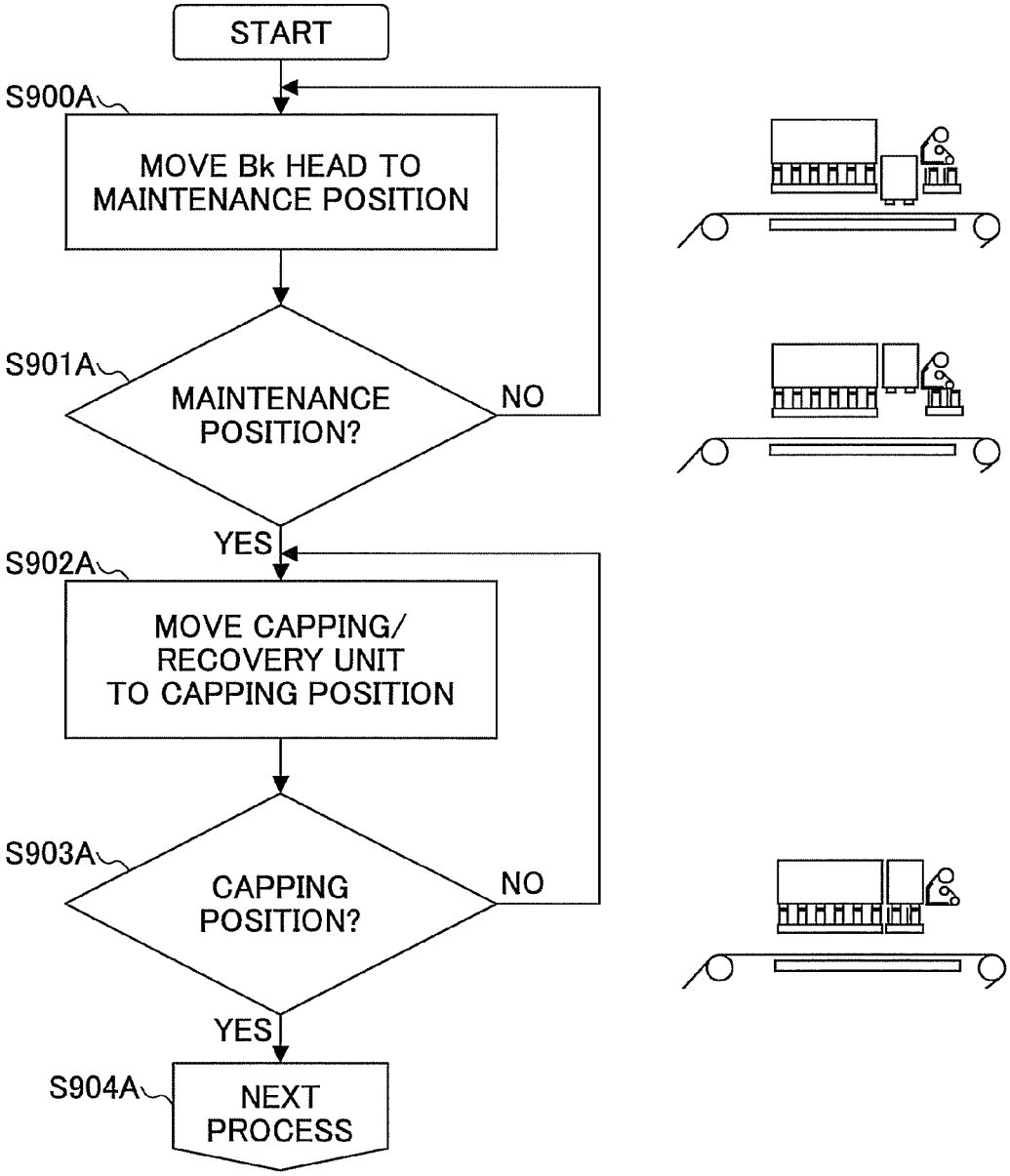
FIG. 9A is a flowchart of a capping process following a monochrome printing operation.

FIG. 9A is a flowchart of a capping sequence that is started at the end of a monochrome image formation. First, the recording head unit 61Bk is moved upward by the head moving mechanism (motor 42 of FIG. 3) to the separated position (S900A, 901A). When the recording head unit 61Bk is in the separated (maintenance) position (FIG. 2), the capping/recovery unit 73 is moved horizontally and vertically by the cap moving mechanism 70 until the group Bk of nozzles of the recording head unit 61Bk is capped with the caps 38 (S902A, 903A) in the capping position. Thereafter, the next process is performed (S904A).

Figure 9B:
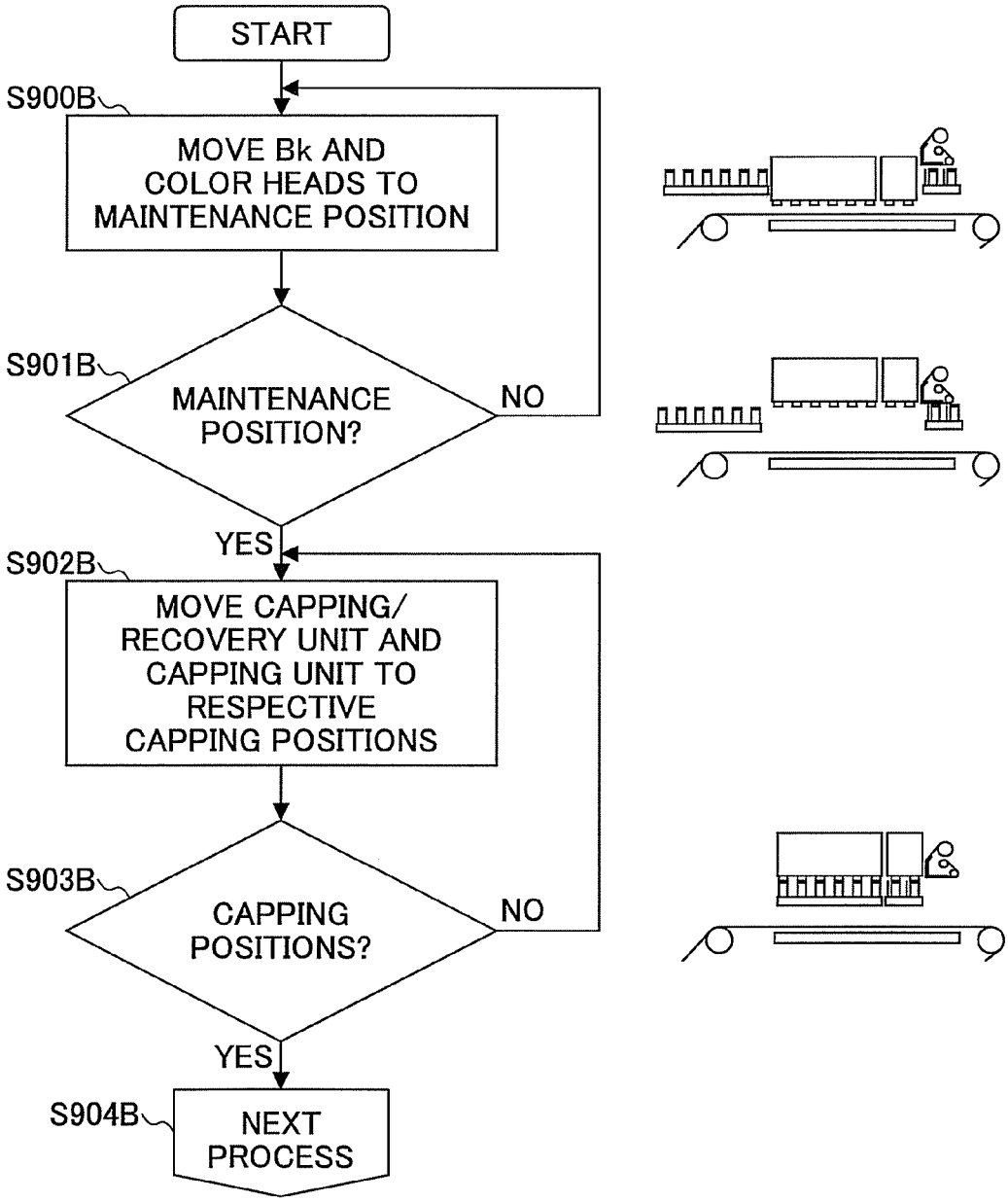
FIG. 9B is a flowchart of a capping process following a color printing operation.

FIG. 9B is a flowchart of the capping sequence at the end of a color image formation process. First, the recording head units 61Bk, 61M, 61C, and 61Y are driven upward to the separated position by the head moving mechanism (motor 42 of FIG. 3) (S900B, 901B). When the recording heads are in the separated position, the capping/recovery unit 73 and the capping unit 73' are moved by the corresponding cap moving mechanisms (77 and 78, 77' and 78') until the group Bk of nozzles of the recording head unit 61Bk is capped with the caps 38 and the groups C1, C2, and C3 of nozzles of the recording head units 61M, 61C, and 61Y are capped with the caps 38' (S902B, 903B). Thereafter, the next process is performed (S904B).

Thus, the recording head units 61Bk, 61M, 61C, and 61Y can be maintained in a proper wet condition, and the increase in viscosity of ink due to drying can be prevented after an image forming operation. However, when the next step is also an image formation operation and there is a long standby time between the two printing processes, the viscosity of the ink in the nozzle may increase to such an extent as to destabilize the discharge performance of the nozzles, particularly when the ambient temperature is high or the ambient humidity is low. Thus, a recovery operation is performed on the recording head units 61Bk, 61M, 61C, and 61Y prior to the next image forming operation as needed. For this purpose, the control unit 40 may read the control sequence table in the ROM 51.

The recovery operation is performed by moving the capping/recovery unit 73 back and forth between the home position and a capping/recovery area opposite the recording head units 61Bk, 61M, 61C, and 61Y, as illustrated in FIGS. 6A and 6B. FIG. 6A illustrates a forward movement (to the left in the drawing) of the capping/recovery unit 73 in the capping/recovery area. FIG. 6B illustrates a backward movement (to the right) of the capping/recovery unit 73 in the opposite area. The recovery operation is performed without moving the recording head units 61Bk, 61M, 61C, and 61Y. Thus, the meniscus in the nozzles of the recording head units 61Bk, 61M, 61C, and 61Y can be prevented from being destabilized or damaged by the vibration of the nozzles, which may result when the recording head units are moved.

In the inkjet printer 100, the recovery operation may involve blank discharge and/or flow-out of ink into the caps 38. Blank discharge involves causing the recording head units 61Bk, 61M, 61C, and 61Y to discharge ink into the caps 38 not for image formation purposes but for renewing the ink in the nozzles. Flow-out includes pressurized flow-out and suctioned flow-out. The pressurized flow-out involves applying a pressure to the recording head units 61Bk, 61M, 61C, and 61Y using the pumps 82BK, 82M, 82C, and 82Y, respectively (see FIG. 1) so that the ink can be caused to flow into the caps 38. The suctioned flow-out involves suctioning the ink out of the recording head units 61Bk, 61M, 61C, and 61Y into the caps 38, using the pump 75 (see FIG. 7).

The flow-out recovery operation may include cleaning the nozzles by wiping the ink off the nozzles using the wipers 39 of the capping/recovery unit 73 (see FIG. 7). The ink removed by the wipers 39 is collected in the recording fluid storage unit, together with the ink that enters the caps 38 during flow-out, via the ejection channel 76.

Either blank discharge or flow-out, or both, may be selected. Recovery by blank discharge may be selected by the control unit 40 depending on the standby time of the recording head units 61Bk, 61M, 61C, and 61Y or the ambient temperature/humidity. Recovery by flow-out may be selected by a user operating the operating panel 41. In the case of recovery by flow-out, either the pressurized flow-out or the suctioned flow-out, or both, may be implemented.

The amount of ink discharged by the recording head units during blank discharge, or the amount of ink flowed out by the recording head units during flow-out, is determined by the control unit 40. The amounts of ink for blank discharge and flow-out may be the same under the same conditions. For example, for blank discharge, an amount of ink required to be discharged by the recording head units 61Bk, 61M, 61C, and 61Y for renewal of the ink in the nozzle is stored in the control sequence table in the ROM 52. Similarly for flow-out, an amount of ink required to be flowed out of the recording head units 61Bk, 61M, 61C, and 61Y for renewal of the ink in the nozzle is stored in the control sequence table in the ROM 52 as a required flow-out amount.

When a recovery operation is performed in order of the recording head units 61Bk, 61M, 61C, and 61Y during the forward movement of the capping/recovery unit 73 as illustrated in FIG. 6A, the viscosity of the ink in the nozzles of the recording head units 61Bk, 61M, 61C, and 61Y starts increasing in the same order after the recovery operation. Particularly, the recording head unit 61Bk that is maintained first needs to wait the longest before the capping/recovery unit 73 is returned to the home position after blank discharge, for example.

Thus, in the inkjet printer 100, when both recovery by blank discharge and flow-out are selected, flow-out is performed during the forward movement (FIG. 6A) and blank discharge is performed during the backward movement of the capping/recovery unit 73 (FIG. 6B). When either blank discharge or flow-out is selected, no maintenance is performed during the forward movement (FIG. 6A) but blank discharge or flow-out is performed during the backward movement (FIG. 6B) of the capping/recovery unit 73. By thus performing at least the recovery operation by blank discharge or flow-out during the backward movement, the standby time between the end of the recovery operation and the return of the capping/recovery unit 73 to the home position can be reduced.

In the case of a recovery operation by blank discharge, the required blank discharged amount may correspond to the amount of ink discharged by each of the recording head units 61Bk, 61M, 61C, and 61Y during the backward movement of the capping/recovery unit 73. In the case of a flow-out recovery operation, the required flow-out amount may correspond to the amount of ink having flowed out of each of the recording head units 61Bk, 61M, 61C, and 61Y during the backward movement of the capping/recovery unit 73.

When both flow-out and blank discharge are performed, the required flow-out discharge amount may correspond to the amount of ink that has flowed out of each of the recording head units 61Bk, 61M, 61C, and 61Y during the forward movement of the capping/recovery unit 73, while the required blank discharge amount for blank discharge may correspond to the amount of ink discharged by each of the recording head units 61Bk, 61M, 61C, and 61Y during the backward movement of the capping/recovery unit 73.

After any of the above recovery operations, a preliminary discharge operation may be performed prior to the next image forming operation. In the preliminary discharge operation, the carriage 37A and/or the carriage 37B is lowered to the recording position depending on whether the image formation involves color image formation or monochrome image formation, and then the head driver 50 causes the recording head units 61Bk, 61M, 61C, and/or 61Y to discharge ink toward the transport belt 11 moving in the sheet transport direction A1 prior to discharging ink for image formation. In this way, the recording head units 61Bk, 61M, 61C, and 61Y are placed in better condition for image formation. The ink discharged by the recording head units 61Bk, 61M, 61C, or 61Y during the preliminary discharge passes through the large number of openings formed in the transport belt 11 and is eventually collected in the ink receiver 15.

Recovery by flow-out may involve an operation of wiping the ink off the nozzles of the recording head units 61Bk, 61M, 61C, and 61Y using the wipers 39. Specifically, when the flow-out recovery operation is performed during the forward movement of the capping/recovery unit 73, because the wipers 39 are positioned downstream of the caps 38 with respect to the direction of movement of the capping/recovery unit 73 (to the left in FIG. 7), the caps 38 are removed from the recording head units 61Bk, 61M, 61C, and 61Y and then the capping/recovery unit 73 is first moved in the upstream direction, followed by engaging the wipers 39 with the recording head units 61Bk, 61M, 61C, and 61Y and then moving the wipers 39 in the downstream direction. On the other hand, when the flow-out recovery operation is performed during the backward movement (to the left) of the capping/recovery unit 73, because the wipers 39 are positioned upstream (to the left) of the caps 38 with respect to the direction of movement of the capping/recovery unit 73 (to the right), the caps 38 are removed from the recording head units 61Bk, 61M, 61C, and 61Y and then the wipers 39 are engaged with the recording head units 61Bk, 61M, 61C, and 61Y and moved in the downstream direction (to the right) without returning the capping/recovery unit 73 in the upstream direction (to the left). Thus, the time for the recovery operation during the backward movement is further reduced.

Figure 10A:
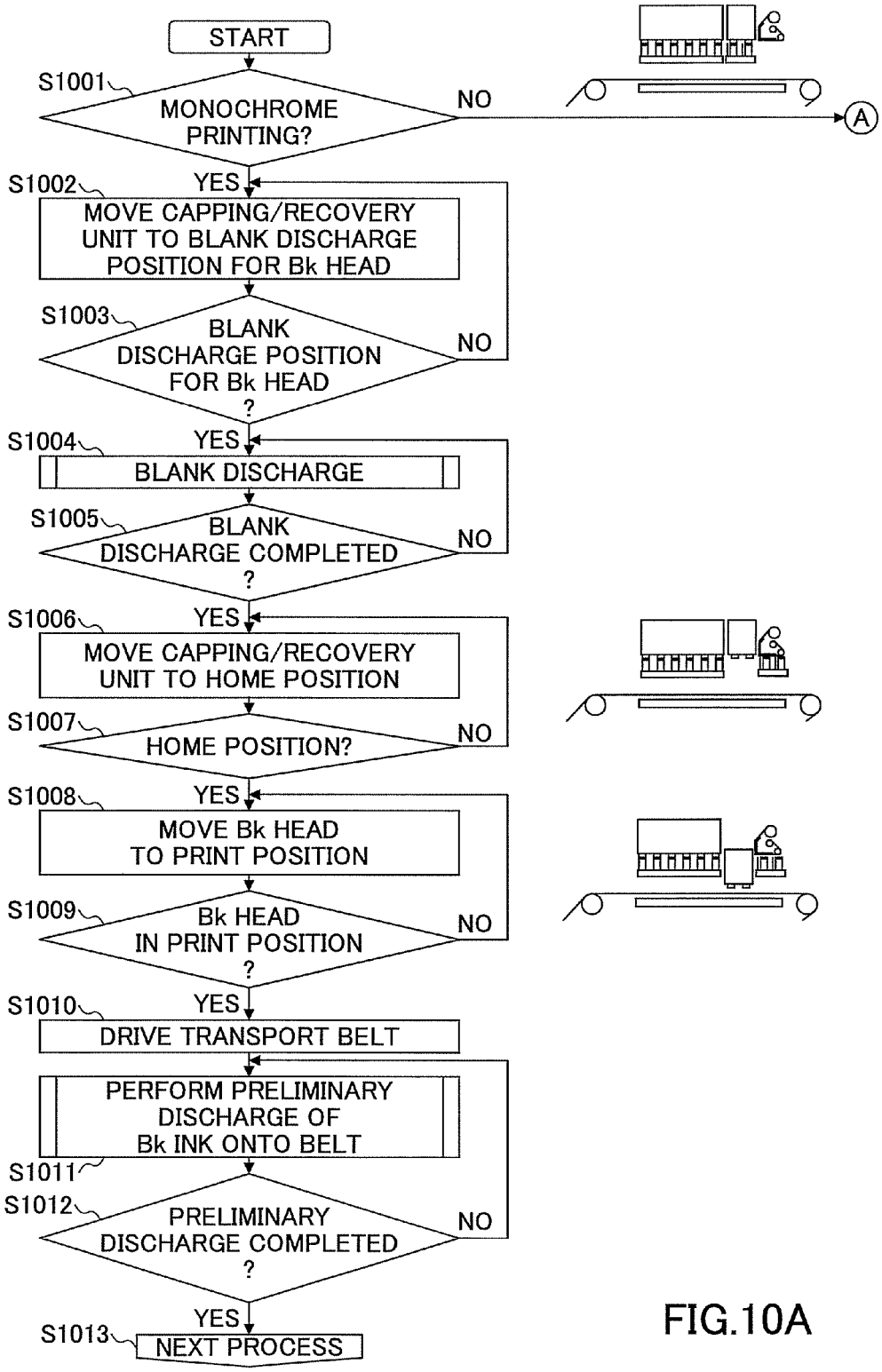
FIGS. 10A and 10B are parts of a flowchart of a maintenance process including blank discharge and preliminary discharge.
Figure 10B:
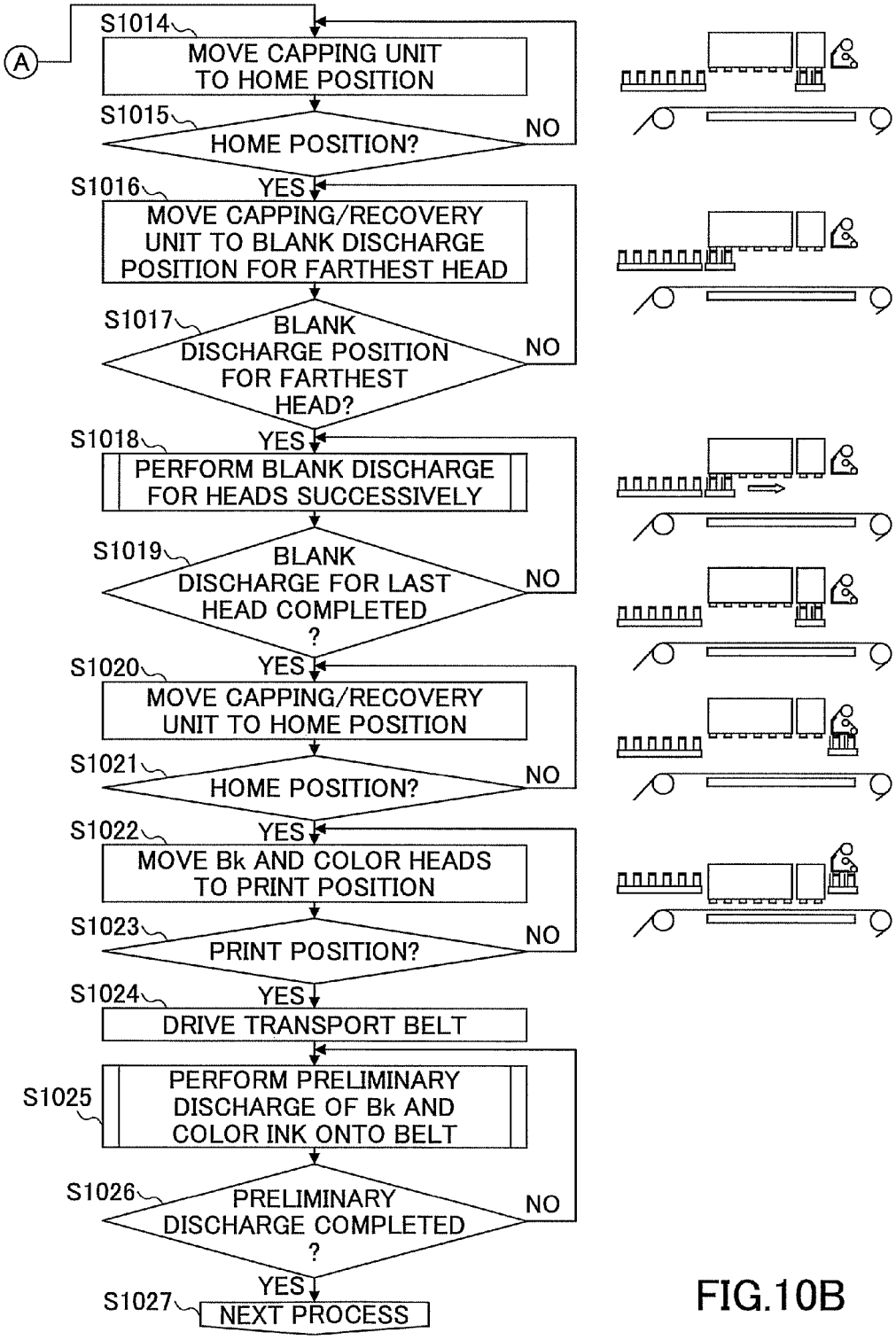

FIGS. 10A and 10B are parts of a flowchart of a recovery operation including blank discharge and preliminary discharge that are performed in succession after the capping operation illustrated in FIG. 9. The control unit 40 may determine to perform the blank discharge operation depending on whether the image formation involves monochrome image formation or color image formation and in view of the standby time of the recording head units 61Bk, 61M, 61C, and 61Y and the ambient temperature/humidity. The control unit 40 then reads the blank discharge sequence from the ROM 52 and starts executing the sequence.

First, it is determined whether the image formation involves monochrome image formation or color image formation (S1001). In the case of monochrome image formation, the capping/recovery unit 73 is driven by the cap moving mechanism 70 until the Bk group of nozzles (FIG. 2) of the recording head unit 61Bk is capped by the caps 38 (S1002, S1003). Then, the head driver 50 drives the recording head unit 61Bk to discharge a required amount of ink into the cap for blank discharge (S1004, S1005). Normally, the Bk group of nozzles of the recording head unit 61Bk is already capped by the caps 38 by the capping operation illustrated in FIG. 9. Thus, the blank discharge in step S1004 may be started immediately thereafter.

Then, the cap moving mechanism 70 drives the capping/recovery unit 73 until the caps 38 are in the home position (S1006, S1007). When the caps 38 are in the home position, the recording head unit 61Bk is moved down to the print position by the cap moving mechanism (motor 53) (S1008, S1009). The transport belt 11 is then rotated (S1010) and a required preliminary discharge amount of ink is discharged by the recording head unit 61Bk (S1011, S1012) for preliminary discharge. Thereafter, the next process is performed (S1013).

When it is determined in step S1001 that color image formation is involved, the capping unit 73' is moved by the cap moving mechanism 72 to the home position, i.e., to the extreme left as illustrated in FIGS. 6A and 6B (S1014, S1015). When the capping unit 73' is in the home position, the capping/recovery unit 73 is moved by the cap moving mechanism 70 from the home position to the farthest blank discharge position, i.e., the position opposite the C1 group of nozzles of the head 61Y, and the C1 group of nozzles is capped by the caps 38 (S1016, S1017). Steps S1014 and S1015 may be performed simultaneously with steps S1016 and S1017.

When the nozzles of the farthest recording head, i.e., the recording head 61Y, are capped by the caps 38, the head driver 50 causes the head 61Y to discharge a required amount of ink for blank discharge. The blank discharge operation are performed successively for the heads 61C, 61M, and 61Bk (S1018). After the blank discharge for the last head, i.e., the recording head unit 61Bk is completed (S1019), the capping/recovery unit 73 is moved by the cap moving mechanism 70 to the home position (S1020, S1021).

When the capping/recovery unit 73 is in the home position, the heads 61Bk, 61M, 61C, and 61Y are moved by the head moving mechanism downward to the print position (S1022, S1023). When the heads 61Bk, 61M, 61C, and 61Y are in the print position, the transport belt 11 is rotated (S1024) and then the heads 61Bk, 61M, 61C, and 61Y are caused to discharge a required amount of ink of the corresponding colors for preliminary discharge (S1025, S1026), followed by the next process (S1027).

Figure 11A:
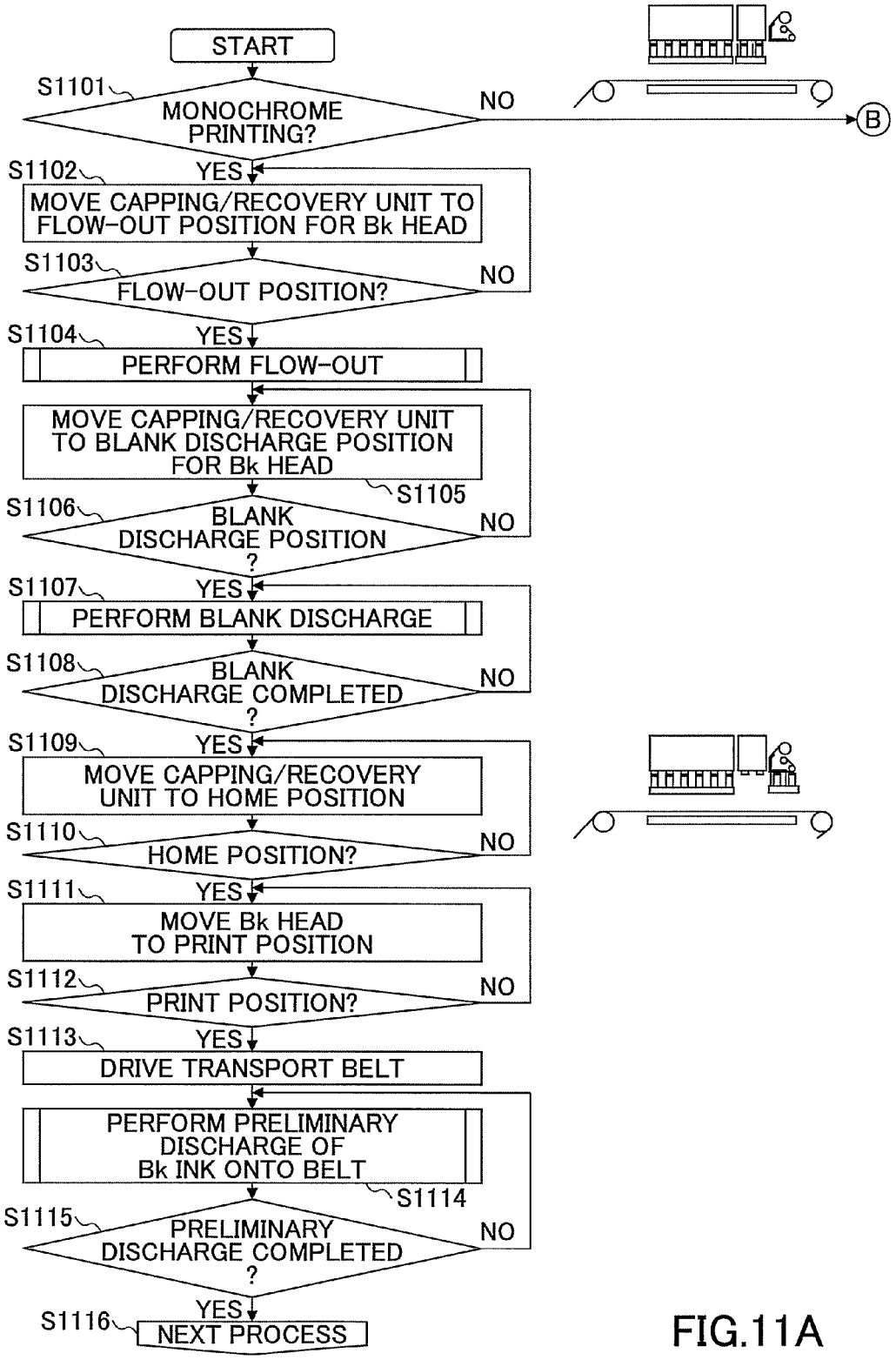
FIGS. 11A, 11B, and 11C are parts of a flowchart of a maintenance process including flow-out, blank discharge, and preliminary discharge.
Figure 11B:
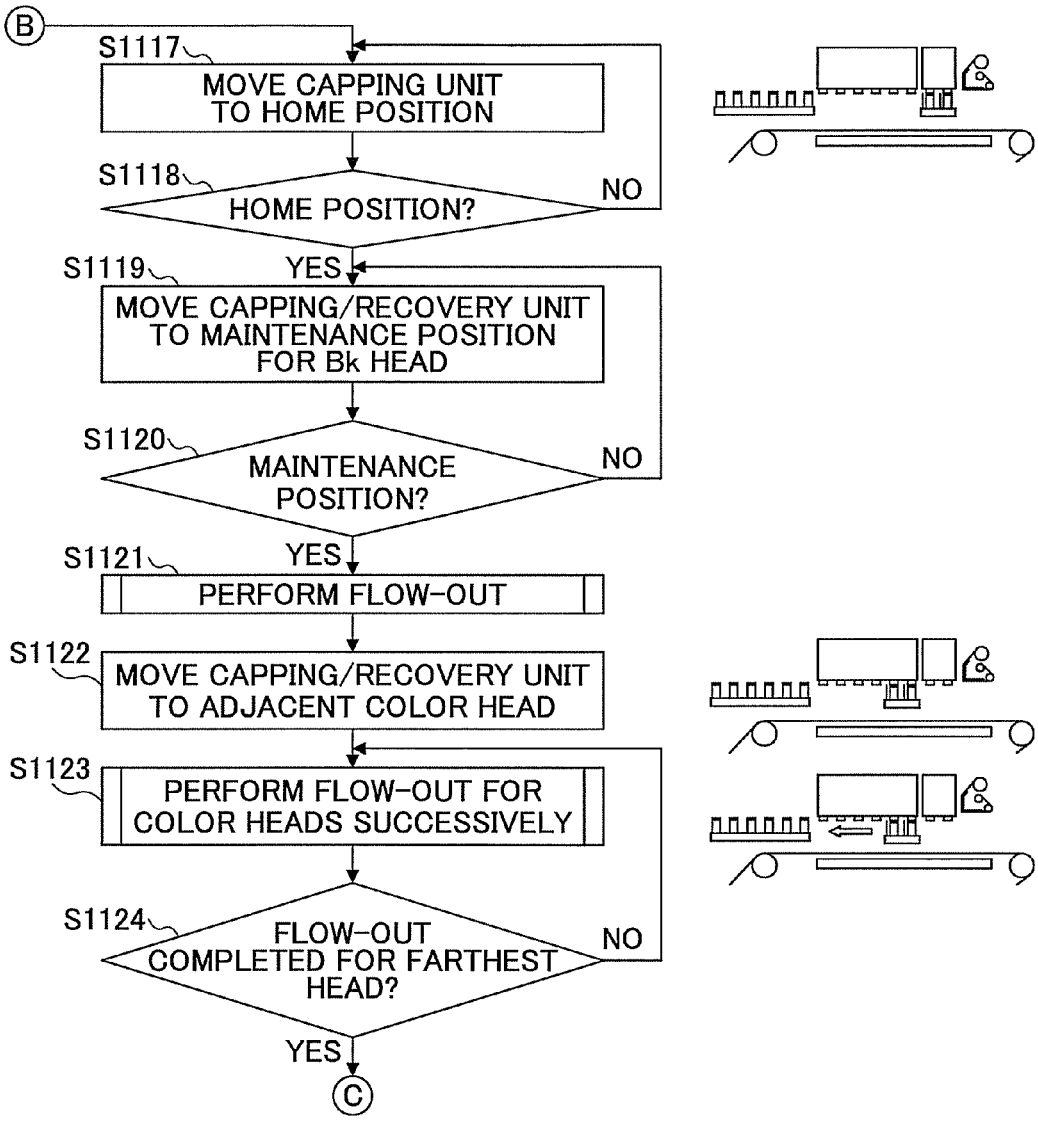
Figure 11C:
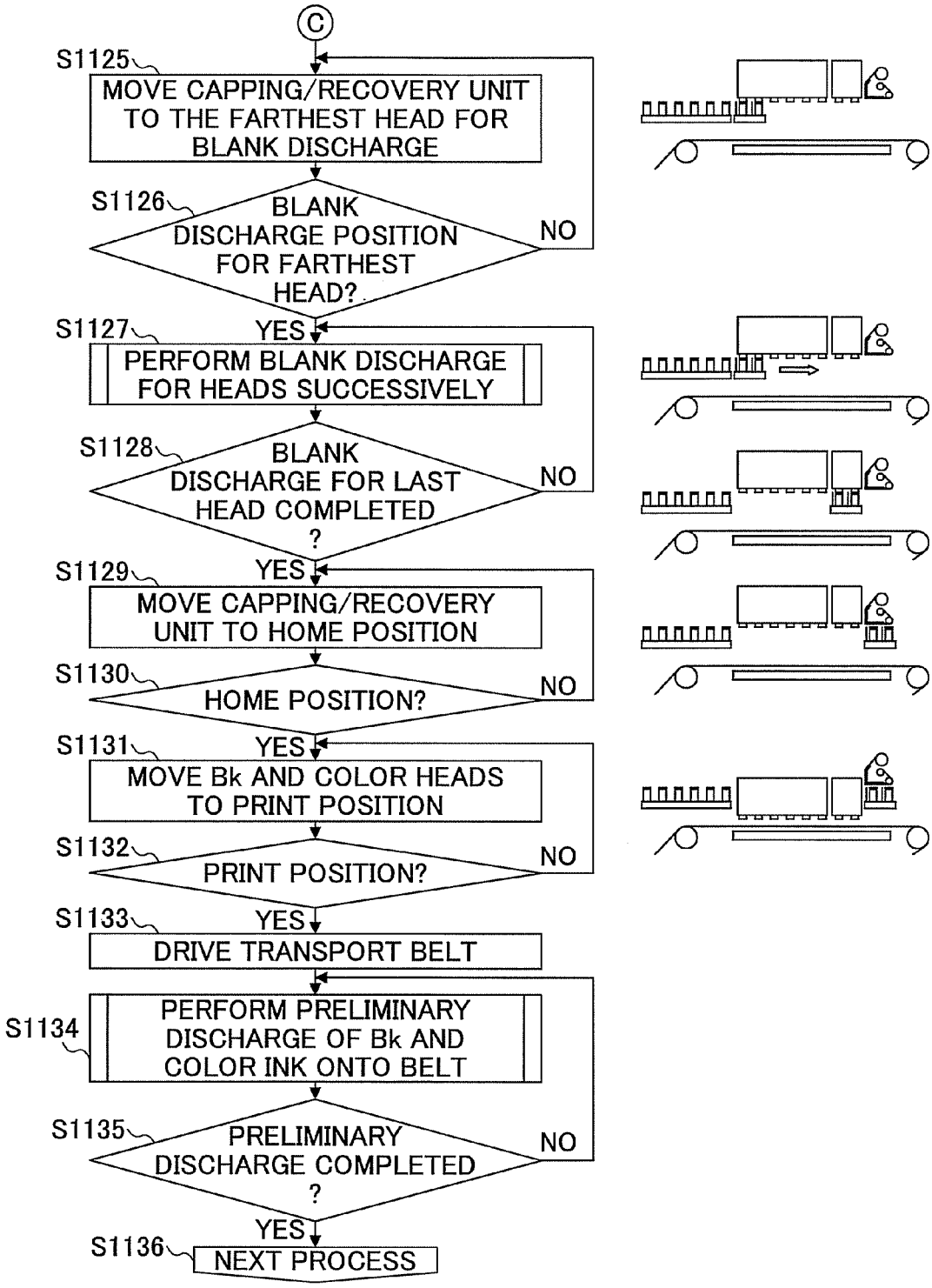

FIGS. 11A, 11B, and 11C are parts of a flowchart of a recovery operation in which flow-out, blank discharge, and preliminary discharge are performed in succession after the capping operation illustrated in FIGS. 9A and 9B. The control unit 40 may select the recovery by flow-out and blank discharge depending on whether the image formation involves monochrome image formation or color image formation, and in view of the standby time of the recording head units 61Bk, 61M, 61C, and 61Y and the ambient temperature/humidity. Once the recovery by flow-out and blank discharge is selected, the control unit 40 reads a recovery sequence from the ROM 52 and starts executing the sequences.

First, it is determined whether the image formation involves monochrome image formation or color image formation (S1101). In the case of monochrome image formation, the capping/recovery unit 73 is moved by the cap moving mechanism 70 (horizontal cap moving unit 77 and vertical cap moving unit 78) until the Bk group of nozzles of the recording head unit 61Bk are capped by the caps 38 (S1102, S1103). When the Bk group of nozzles of the recording head unit 61Bk is capped by the caps 38, a flow-out recovery operation is performed by causing a required amount of ink to flow out of the recording head unit 61Bk by driving either the pump 82BK or the pump 75 (S1104). Normally, the recording head unit 61Bk is already capped by the caps 38 by the capping operation illustrated in FIG. 9. Thus, the flow-out recovery operation in step S1104 may be stated immediately thereafter.

After a cleaning operation is performed for the recording head unit 61Bk by the wipers 39 (involving removal of the caps 38 from the Bk group of nozzles, moving the capping/recovery unit 73 in the direction of the home position, and moving the wipers 39 in the downstream direction), the capping/recovery unit 73 is again moved by the cap moving mechanism 70 until the Bk group of nozzles of the recording head unit 61Bk are capped by the caps 38 (S1105, S1106). When the Bk group of nozzles is capped (hermetically closed) by the caps 38, the recording head unit 61Bk is driven by the head driver 50 to discharge a required discharged amount of ink for blank discharge (S1107, S1108).

Thereafter, the capping/recovery unit 73 is moved by the cap moving mechanism 70 until the caps 38 are in the home position (S1109, S1110). Thereafter, the recording head unit 61Bk is moved downward to the print position by the head moving mechanism (S1111, S1112). When the recording head unit 61Bk is in the print position, the transport belt 11 is rotated (S1113), then the recording head unit 61Bk is caused to discharge a required amount of ink for preliminary discharge (S1114, S1115), and then the next step is performed (S1116).

When it is determined in step S1101 that the image formation involves color image formation, the capping unit 73' is moved by the cap moving mechanism 72 (horizontal cap moving unit 77' and vertical cap moving unit 78') to the home position (S1117, S1118).

When the capping unit 73' is in the home position, the capping/recovery unit 73 is driven by the cap moving mechanism 70 horizontally and vertically until the Bk group of nozzles of the recording head unit 61Bk is capped by the caps 38 (S1119, S1120). When the Bk group of nozzles of the recording head unit 61Bk is capped, a required amount of ink is caused to flow out of the recording head unit 61Bk for a flow-out recovery operation by driving either the pump 82BK or the pump 75 (S1121). Normally, the recording head unit 61Bk is already capped by the caps 38 by the capping operation illustrated in FIG. 9, so that the flow-out recovery operation in step S1104 may be started immediately.

After a cleaning operation for the recording head unit 61Bk by the wipers 39 (involving moving the capping/recovery unit 73 in the upstream direction and then moving the wipers 39 in the downstream direction), the capping/recovery unit 73 is again moved by the cap moving mechanism (horizontal cap moving unit 77 and vertical cap moving unit 78) to the adjacent recovery position, i.e., opposite the C1 group of nozzles of the head 61M (S1122).

When the C1 group of nozzles is capped by the caps 38, a required amount of ink is caused to flow out of the head 61M for a flow-out recovery operation by activating either the pump 82M or the pump 75. The flow-out recovery operation is repeated for the heads 61C and 61Y in succession (S1123 and S1124) by activating either the pump 82M or the pump 75. When the flow-out recovery operation is completed for the head 61Y, which is in the farthest recovery position from the home position of the capping/recovery unit 73 (S1124), a cleaning operation is performed for the recording heads 61Bk, 61M, 61C, and 61Y by the wipers 39.

Thereafter, the capping/recovery unit 73 is moved by the cap moving mechanism from the home position to the farthest recovery position where the C1 group of nozzles of the head 61Y is capped by the caps 38 (S1125, S1126). When the nozzle group C1 is capped by the caps 38, the head 61Y is driven by the head driver 50 so that a required amount of ink is discharged by the head 61Y for blank discharge. The blank discharge operation is repeated for the heads 61C, 61M, and 61Bk (S1127) in succession. When the blank discharge operation is completed for the recording head unit 61Bk (S1128), the capping/recovery unit 73 is moved by the cap moving mechanism 70 to the home position (S1129, S1130).

When the capping/recovery unit 73 is in the home position, the heads 61Bk, 61M, 61C, and 61Y are moved downward to the print position by the head moving mechanism (S1131, S1132). When the heads 61Bk, 61M, 61C, and 61Y are in the print position, the transport belt 11 is rotated (S1133) and then the heads 61Bk, 61M, 61C, and 61Y are caused to discharge a required amount of ink for preliminary discharge (S1134, S1135), followed by the next process (S1136).

Figure 12:
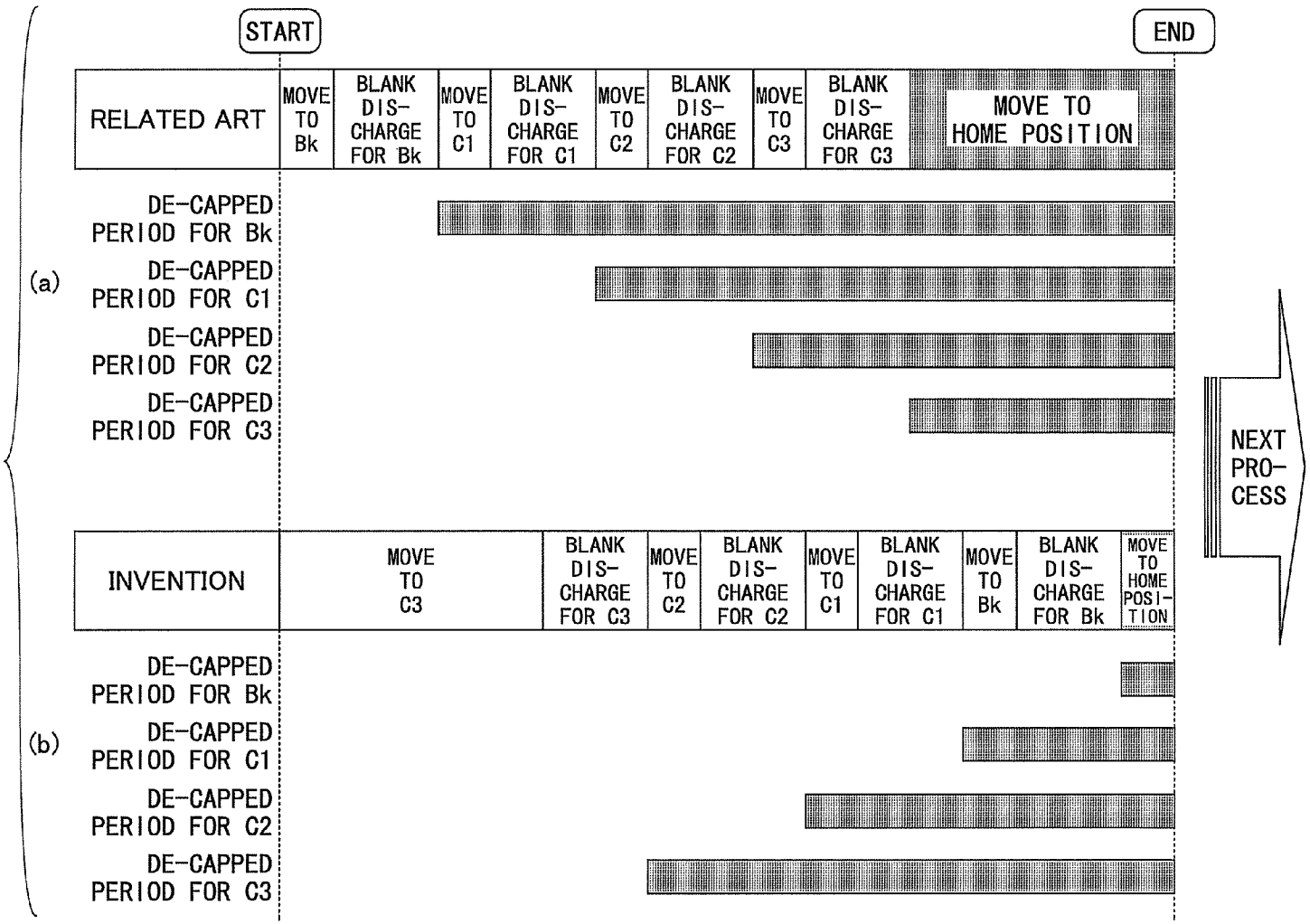
FIG. 12 illustrates the decrease in standby time after a maintenance operation according to an embodiment of the present invention.

By such an operation, the standby time between the end of the recovery operation of the recording head units 61Bk, 61M, 61C, and 61Y and the return of the capping/recovery unit 73 to the home position can be reduced, as illustrated in FIG. 12. FIG. 12(*a*) illustrates the stand-by time, which is designated as "de-capped period" in the drawing, in the case of a conventional technology where blank discharge is performed during the forward movement of the capping/recovery unit 73. FIG. 12(*b*) indicates the case where blank discharge is performed during the backward movement of the capping/recovery unit 73 in accordance with the present embodiment of the invention as illustrated in FIG. 10 (for color printing).

In the examples of FIG. 12, while the required time between the start and end of the recovery operation is the same, the standby time of the nozzle groups Bk, C1, C2, and C3 is less for the example of FIG. 12(*b*) than that of FIG. 12(*a*). Particularly, the standby time of the head group Bk, which is located the closest to the home position of the capping/recovery unit 73, is greatly reduced. Thus, a proper ink discharge performance of the recording head units 61Bk, 61M, 61C, and 61Y can be maintained for the subsequent image formation process, thus contributing to the decrease in disturbance in the printed image.

When the recording fluid comprises a water-pigment ink, the amount of ink that is discharged for recovery needs to be increased because of a relatively high rate at which the viscosity of the water-pigment ink increases. Thus, the movement of the capping/recovery unit 73 needs to be stopped longer at each recovery position, resulting in an increase in the entire standby time. Thus, the decrease in standby time according to the present embodiment contributes greatly to satisfactory image formation. On the other hand, when the required discharge amount of recording fluid for recovery may be small due to the performance of the recording fluid or the environment, the need to stop the capping/recovery unit 73 during the backward movement may be eliminated, thus further reducing the overall standby time.

While the recovery operation has been described mainly as regards blank discharge in the backward movement, the standby time may be similarly reduced by a similar control of the recording head units 61M, 61C, and 61Y for a flow-out recovery operation during the backward movement.

When a color image formation process is performed following the above recovery operation, the carriages 37A and 37B are lowered to the recording position, and a preliminary discharge operation may be performed prior to the discharge of ink toward the sheet S for image formation. In the preliminary discharge operation, the recording head units 61Bk, 61M, 61C, and 61Y are caused by the head driver 50 to discharge ink toward the transport belt 11, i.e., not the sheet S, moving in the A1 direction. In this way, the recording head units 61Bk, 61M, 61C, and 61Y can be placed in better condition for image formation. The amount of ink for the preliminary discharge may be determined in view of the length of the standby time of the recording head units 61Bk, 61M, 61C, and 61Y.

Because the standby time of the recording head increases in order of 61Bk, 61M, 61C, and 61Y as will be seen from FIG. 12(*b*), the preliminary discharge amount of the recording head units 61Bk, 61M, 61C, and 61Y is increased in the same order. Namely, the recording head units 61Bk, 61M, 61C, and 61Y are driven by the head driver 50 such that the preliminary discharge amount is the most for the head 61Y, which is on the starting side of the backward movement of the capping/recovery unit 73, relative to the recording head unit 61Bk on the home position end.

The preliminary discharge amount of the recording head units 61Bk, 61M, 61C, and 61Y may be minimized as long as a uniform ink discharge condition can be achieved by the recording head units 61Bk, 61M, 61C, and 61Y during image formation. In this way, better image formation may be achieved. Because the standby time of the recording head units 61M, 61C, and 61Y after blank discharge or flow-out is reduced in accordance with the present embodiment, the preliminary discharge amount is also reduced. The decrease in preliminary discharge amount contributes to a decrease in image formation cost. Similarly, when the heads have been placed in a non-activated status for a period after the recovery operation and therefore the recording head units 61Bk, 61M, 61C, and 61Y need to be recovered again, the required discharge amount can be reduced, thus reducing the image formation cost.

The ROM 51 may store a head maintenance program for the above head maintenance (capping and recovery) process. The head maintenance program may be stored in other computer-readable recording media, such as semiconductor media (RAM or a non-volatile memory), optical media (DVDs (digital versatile disc), MOs (magneto optic) discs, MDs (mini disc), and CD-R (compact disc recordable)), and magnetic media (hard disks, magnetic tape, and flexible disks).

Figure 13A:
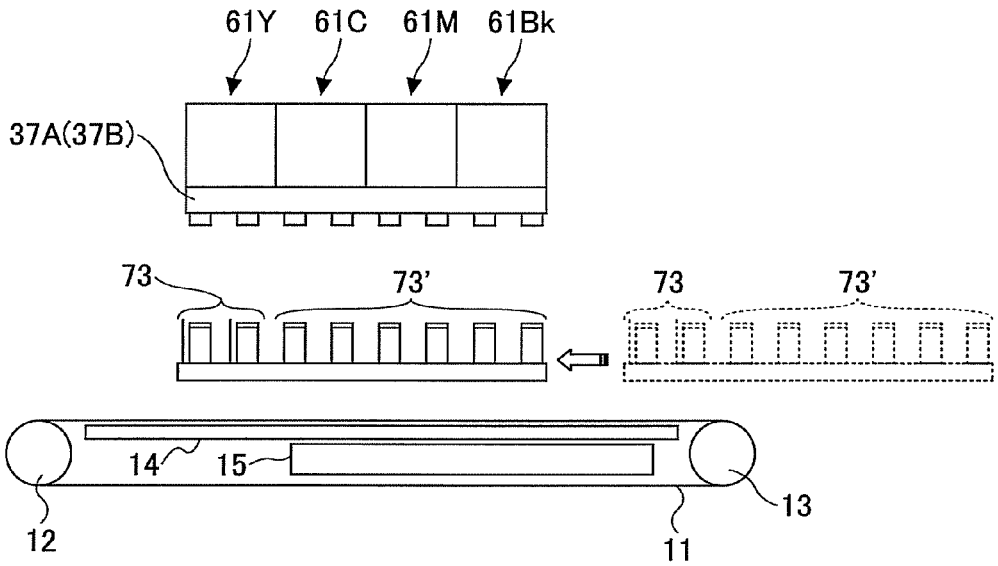
FIGS. 13A and 13B illustrate a recording head unit and a capping/recovery unit according to another embodiment of the present invention.
Figure 13B:
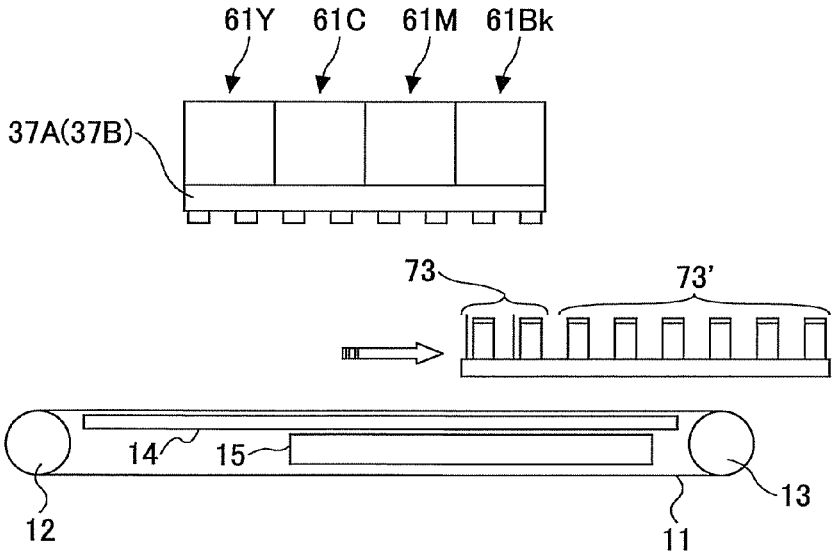

In another embodiment of the present invention, the carriages 37A and 37B may be integrated, as illustrated in FIGS. 13A and 13B, so that the recording head units 61Bk, 61M, 61C, and 61Y can be retained and moved together vertically. Also, the capping/recovery unit 73 and the capping unit 73' may be integrated, as illustrated in FIGS. 13A and 13B, so that they can be moved vertically or horizontally together. In this case, the cap moving mechanism 70 and 72 (77 and 78, and 77' and 78') can be simplified. In this case, the head 61Y may be capped by the capping/recovery unit 73 in the most downstream position with respect to the home position (indicated by a broken line in FIG. 13A).

In the foregoing embodiment, each of the recording head units 61Bk, 61M, 61C, and 61Y has two rows of nozzles extending in a direction perpendicular to the sub-scan direction (corresponding to the sheet transport direction), and the caps 38, 38', and the wipers 39 of the capping/recovery unit 73 and/or the capping unit 73' are aligned to the two rows of the nozzles. Thus, the two rows of nozzles of each of the recording head units 61Bk, 61M, 61C, and 61Y can be capped or wiped at once, thus reducing the number of times of movement of the capping/recovery unit 73 and the capping unit 73' during maintenance and thus reducing the time required for maintenance. The number of rows of the caps and wipers along the sub-scan direction may be smaller than the number of rows of the nozzles of the recording head units 61Bk, 61M, 61C, and 61Y, so that the width of the capping/recovery unit 73 or the capping unit 73' along the sub-scan direction (sheet transport direction) can be reduced. The number of rows of the nozzles of the recording head units 61Bk, 61M, 61C, and 61Y is not limited to two and may be three or more.

While the capping unit 73' is adapted for capping all of the color recording head units 61M, 61C, and 61Y, separate capping units may be provided for the individual color recording head units 61M, 61C, and 61Y, particularly when, for example, the capping units do not include maintenance units such as a suction unit or a wiping member, as in the foregoing example.

The order of arrangement of the recording head units is not limited to that of the foregoing embodiment, i.e., black, magenta, cyan, and yellow in the A1 direction. The colors of the recording fluid discharged by the heads are also not limited to those of the foregoing examples and may include other secondary colors or various shades of grey. The function of the vertical cap moving units 78 and 78' may be provided by the head moving mechanism.

Examples of image forming apparatuses to which an embodiment of the present invention may be applied include a copy machine, a facsimile machine, a printer, a multifunction peripheral having multiple image forming or processing functions, an image forming apparatus for electric circuit formation, and an image forming apparatus used in various fields of technology, such as biotechnology.

Prevention of Staining by Ink Mist

Figure 14:
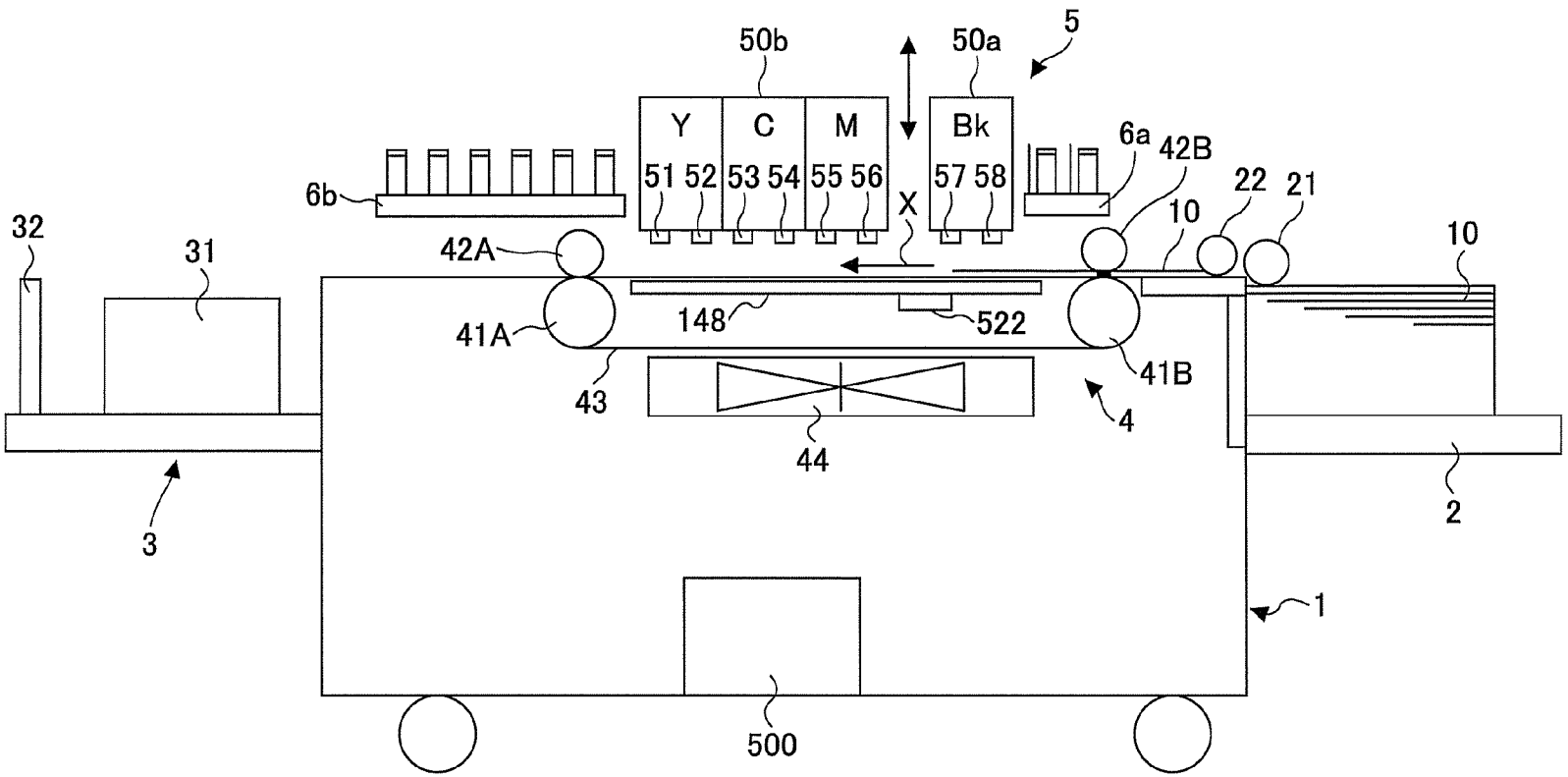
FIG. 14 illustrates an image forming apparatus according to another embodiment of the present invention.

FIG. 14 illustrates an inkjet image forming apparatus 200 according to another embodiment of the present invention. The inkjet image forming apparatus 200, which is of a line-type, includes an apparatus main body 1, a sheet-feeding tray 2 for storing sheets 10 (recording medium), and an ejected-sheet tray 3 for storing the sheet 10 that has been printed. A transport unit 4 is disposed in the apparatus main body 1 for transporting the sheet 10 from the sheet-feeding tray 2 to the ejected-sheet tray 3. An image formation unit 5 is disposed above the transport unit 4. The image formation unit 5 includes a black head unit 50*a* for black (Bk) and a color head unit 50*b* for yellow (Y), cyan (C), and magenta (M). The black head unit 50*a* and the color head unit 50*b* are ink discharge units for discharging ink droplets of black and other colors onto the sheet 10 for image formation. A capping/recovery unit 6*a* is configured to cap the nozzles 57 and 58 of the black head unit 50*a*. A capping unit 6*b* is configured to cap the nozzles of the color head unit 50*b*. The capping/recovery unit 6*a* is also used for a nozzle recovery operation for both the black head unit 50*a* and the color head unit 50*b*.

The inkjet image forming apparatus 200 also includes a control unit 500 and an ink supply system (not shown) for supplying ink to the black head unit 50*a* and the color head unit 50*b*. The ink supply system may include a sub tank and a main tank. The apparatus main body 1 may include front and back plates, side plates, and a stay, which are not illustrated. The sheet 10 is fed from the sheet-feeding tray 2 one sheet at a time onto the transport unit 4 by a separating roller 21 and a feeding roller 22.

The transport unit 4 includes a drive roller 41A, a driven roller 41B, and an endless transport belt 43 extended across the rollers 41A and 41B. The transport belt 43 has a number of suction openings (not shown). Under the transport belt 43, there is disposed a suction fan 44 for retaining the sheet 10 on the surface of the transport belt 43 by suction of air via the suction openings. Guide rollers 42A and 42B are retained by a guide member (not shown) above the drive roller 41A and the driven roller 41B, respectively. The guide rollers 42A and 42B are in contact with the transport belt 43 by their own weight. A belt support member 148 is disposed on a back side of the transport belt 43. The support member 148 supports the transport belt 43 from below in an area between the drive roller 41A and the driven roller 41B.

The transport belt 43 is configured to be rotated by the drive roller 41A which is rotated by a belt drive motor 512 as illustrated in FIG. 4. The sheet 10 is thus transported on the transport belt 43 while being held on the transport belt 43 by the suctioning action of the suction fan 44. The driven roller 41B and the guide rollers 42A and 42B are rotated by the rotation of the transport belt 43. The ejected-sheet tray 3 is disposed downstream of the transport unit 4 in a sheet transport direction X. The ejected-sheet tray 3 includes a pair of side fences 31 for regulating the sheet 10 in its width direction and an end fence 32 that regulates the front end of the sheet 10.

The black head unit 50*a* includes a line-type recording head having rows of nozzles 57 and 58 for discharging ink droplets of black (K) onto the sheet 10. The rows of the nozzles 57 and 58 extend along the sheet width direction, i.e., the rows are perpendicular to the sheet transport direction X. The color head unit 50*b* includes line-type recording head units having rows of nozzles 51 through 56 for discharging ink droplets of the three colors yellow (Y), cyan (C), and magenta (M) onto the sheet 10. The rows of the nozzles 51 through 56 extend along the sheet width direction, i.e., the rows are perpendicular to the sheet transport direction. The recording head units of the black head unit 50*a* and the color head unit 50*b* are arranged in order of Y, C, M, and Bk from the downstream side (to the left in FIG. 14) of the sheet transport direction X. The order of the colors of the color head unit 50*b* is not limited to the above. The colors may include other secondary colors or various shades of grey, with a corresponding increase in the number of nozzles of the heads of the color head unit 50*b*.

Figure 18:
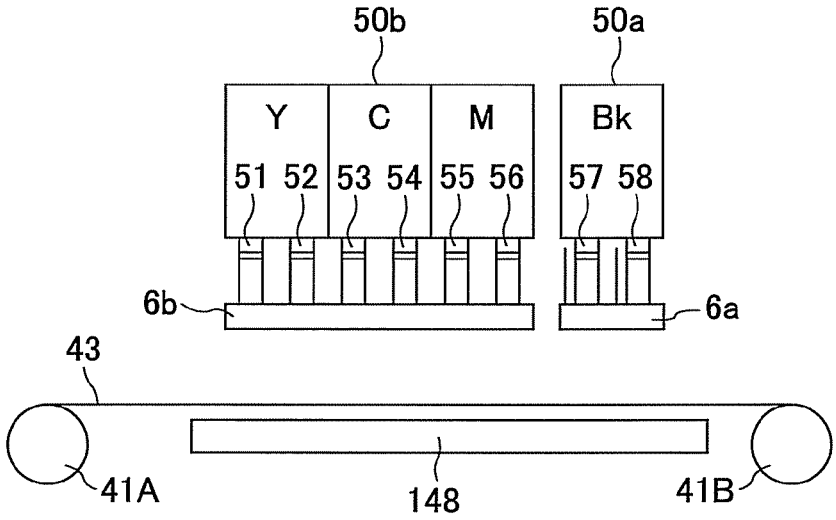
FIG. 18 illustrates a standby status of the head units and the capping units.
Figure 20:
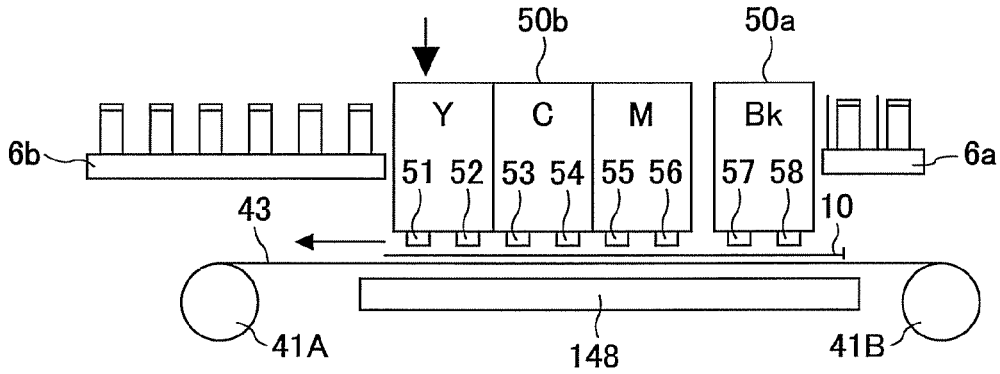
FIG. 20 illustrates the position of the recording head units for a color printing operation.

The black head unit 50*a* and the color head unit 50*b* are disposed adjacent to each other, and both are configured to be moved vertically independently by a head moving unit (not shown) between the print position illustrated in FIGS. 14 and 20, where ink droplets are discharged by the heads onto the sheet 10 on the transport belt 43, and the separated position above the print position, as illustrated in FIG. 18. The head moving unit may include a cam mechanism or a belt-and-pulley mechanism.

The image formation unit 5 may be configured to perform a recovery operation for recovering a proper ink discharge performance of the nozzles 51 through 58 of the recording head units. The recovery operation includes blank discharge and flow-out, as described above with reference to the foregoing embodiment. The recovery operation is performed in the standby position of FIG. 18, as will be described in detail later.

The capping/recovery unit 6*a* and the capping unit 6*b* are configured to cap, i.e., hermetically close, the nozzles 51 through 58 when moved to a capping position under the head units 50*a* and 50*b*. The caps of the capping/recovery unit 6*a* and the capping unit 6*b* are connected to a suction unit and a pressure chamber so that the discharged ink can be ejected out of the caps. The capping/recovery unit 6*a* also includes a wiping member for wiping the surface of the nozzles of the recording head units.

Figure 15:
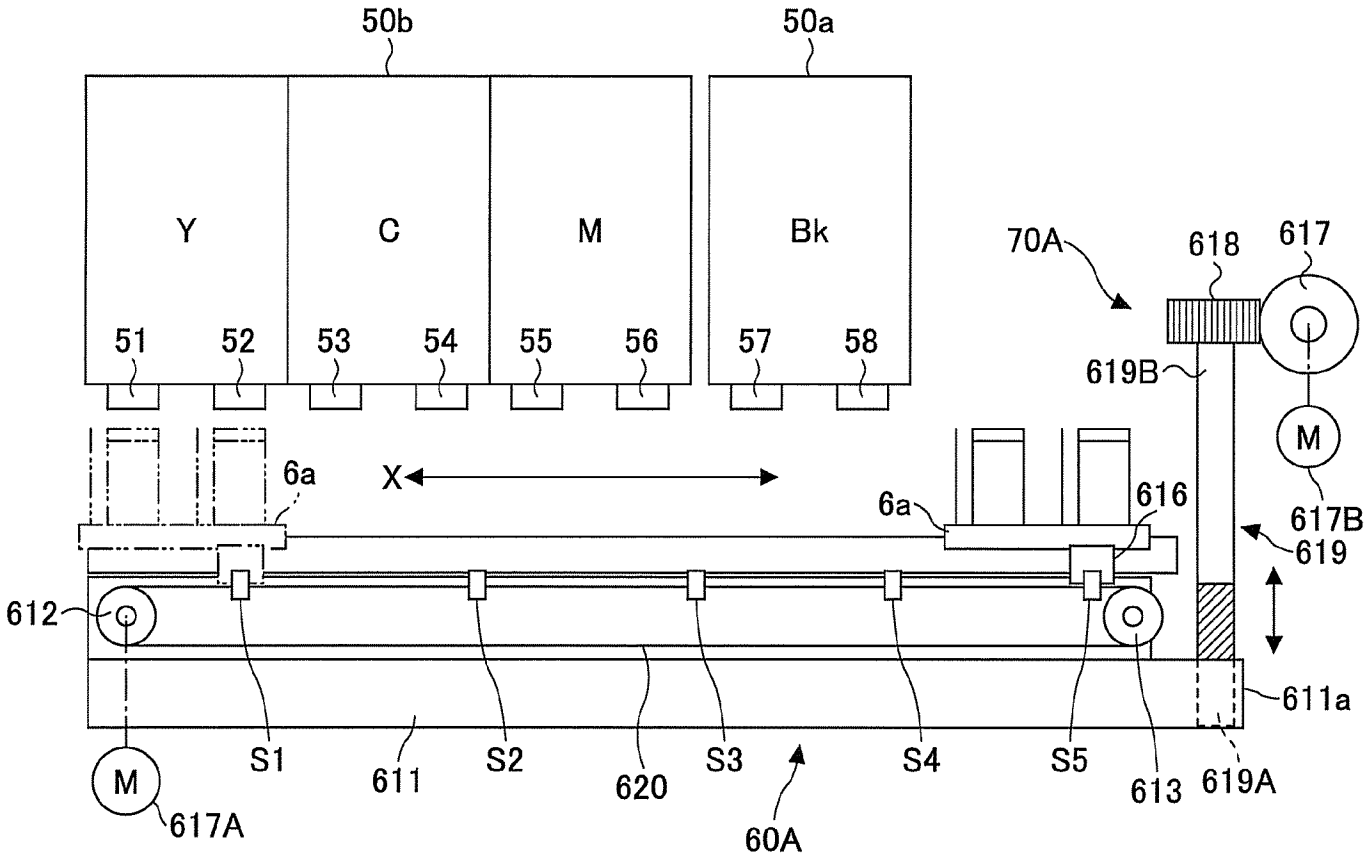
FIG. 15 illustrates the movement of a capping/recovery unit during a maintenance operation.
Figure 16:
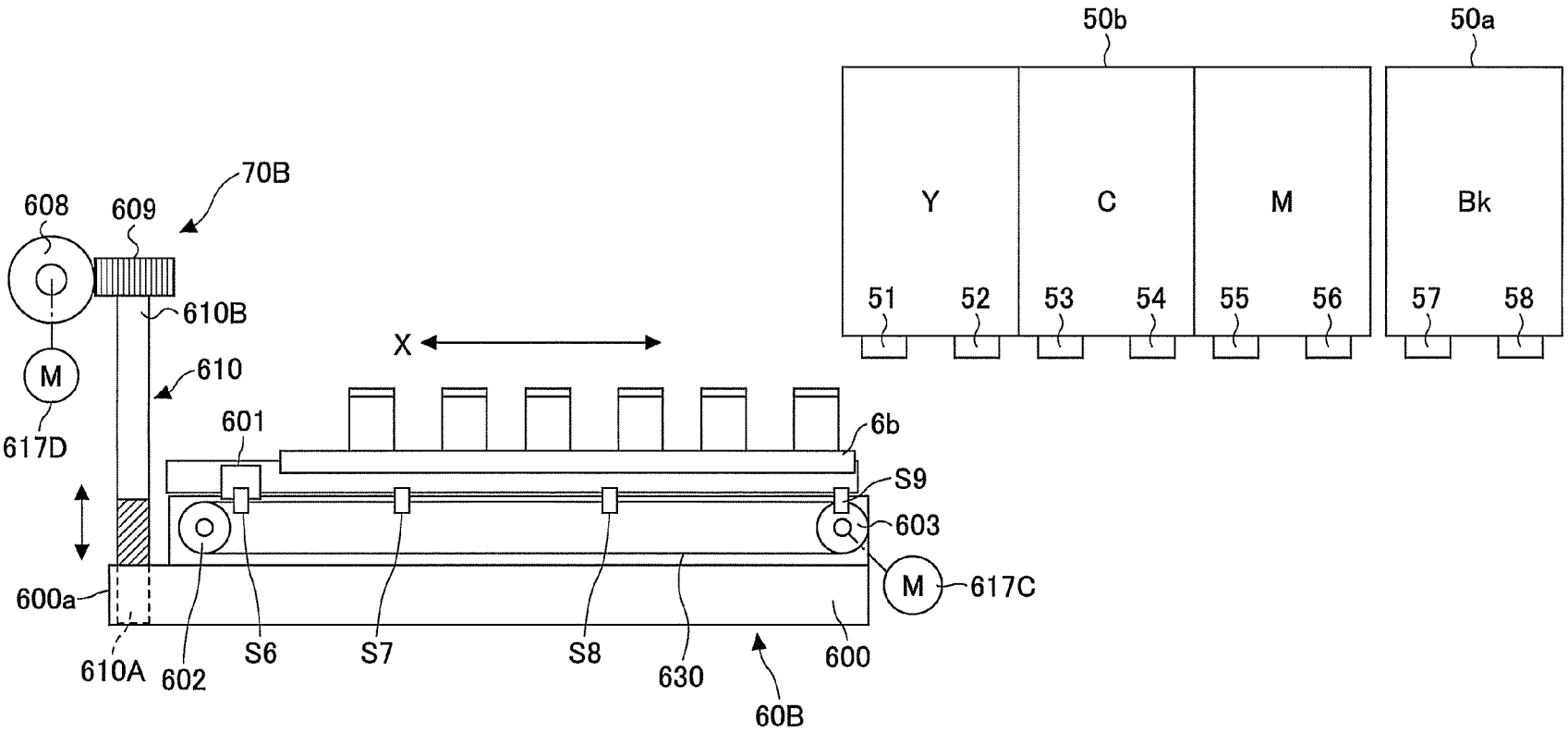
FIG. 16 illustrates an operation of a capping unit for the color recording head units.

The image forming apparatus 200 further includes a horizontal cap moving unit 60A for moving the capping/recovery unit 6*a* between a position opposite any of the color recording heads and a home position where the capping/recovery unit 6*a* is not opposite any of the recording heads, as illustrated in FIG. 15. The image forming apparatus 200 also includes a cap moving unit 60B for moving the capping unit 6*b* between a position below one or more of the color recording heads and a home position, where the capping unit 6*b* is not opposite any of the recording heads, as illustrated in FIG. 16. The image forming apparatus 200 further includes vertical cap moving units 70A and 70B for moving the capping/recovery unit 6*a* and the capping unit 6*b*, respectively, to the capping position where the nozzles of the black head unit 50*a* and the color head unit 50*b* are capped by the caps 6*a* and 6*b*.

With reference to FIG. 15, the horizontal cap moving unit 60A and the vertical cap moving unit 70A for the capping/recovery unit 6*a* are described. The horizontal cap moving unit 60A includes a drive pulley 612 and a driven pulley 613, a belt 620 extended across the pulleys 612 and 613, a fixing member 616 for fixing the capping/recovery unit 6*a* to a part of the belt 620, a base member 611 that rotatably supports the pulleys 612 and 613 and also supports the capping/recovery unit 6*a*, and a maintenance movement motor 617A for driving the drive pulley 612.

Figure 19:
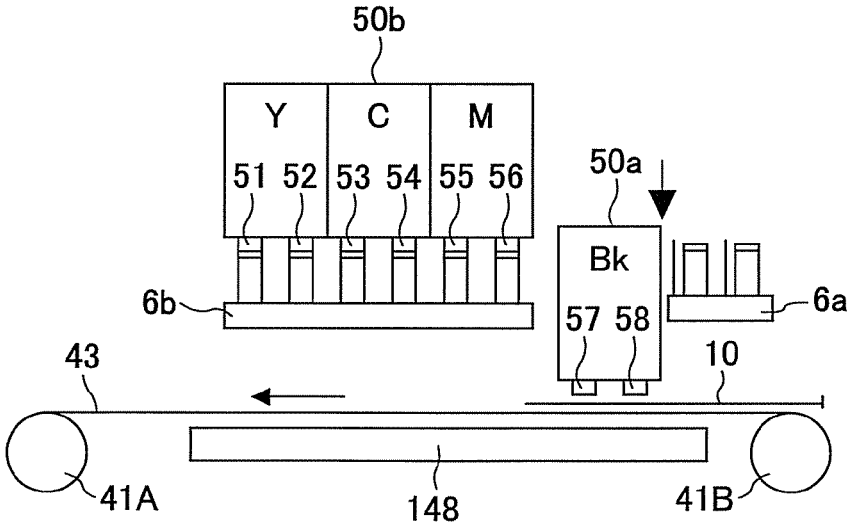
FIG. 19 illustrates the position of the recording head unit for black for a monochrome printing operation.

The capping/recovery unit 6*a* can be moved back and forth along the sheet transport direction X when the belt 620 is moved by the rotation of the drive pulley 612 between the home position of FIGS. 15 and 19 and the position opposite the farthest nozzles, i.e., the nozzles 51 and 52 of the head unit Y. The horizontal position of the capping/recovery unit 6*a* is detected by detection sensors S1 through S5 disposed between the home position and the head unit Y along the belt 620. The detection sensor S1 detects a first opposite position opposite the nozzles 51 and 52 of the head unit Y; the detection sensor S2 detects a second opposite position opposite the nozzles 53 and 54 of the head unit C; the detection sensor S3 detects a third opposite position opposite the nozzles 55 and 56 of the head unit M; the detection sensor S4 detects a fourth opposite position opposite the nozzles 57 and 58 of the black head unit 50*a*; and the detection sensor S5 detects the home position.

One end 611*a* of the base member 611 is in threaded engagement with one end 619A of a threaded shaft 619 (drive shaft), which extends vertically in FIG. 15. On the other end 619B of the shaft 619, there is fixed a gear 618 in meshed engagement with a drive gear 617 rotated by a maintenance movement motor 617B, which may include a stepping motor. The drive gear 617, the gear 618, the shaft 619, and the maintenance movement motor 617B constitute the vertical cap moving unit 70A.

In the vertical cap moving unit 70A, as the drive gear 617 is rotated by the maintenance movement motor 617B, the shaft 619 is rotated via the gear 618, so that the base member 611 can be moved vertically up or down, i.e., between a capping position and an opposite position. By reversing the direction of rotation of the maintenance movement motor 617B, the direction of movement of the base member 611 can be changed. The opposite position or the capping position may be detected with reference to the number of pulses when the maintenance movement motor 617B comprises a stepping motor. Alternatively, a separate sensor may be provided for detecting the position of the capping/recovery unit 6*a*.

With reference to FIG. 16, the horizontal cap moving unit 60B and the vertical cap moving unit 70B for moving the capping unit 6*b* are described. The horizontal cap moving unit 60B includes a driven pulley 602 and a drive pulley 603, a belt 630 extended across the pulleys 602 and 603, a fixing member 601 for fixing the capping unit 6*b* to a part of the belt 630, a base member 600 that rotatably supports the pulleys 602 and 603 and that also supports the capping unit 6*b*, and a maintenance movement motor 617C (drive unit) that rotates the drive pulley 603.

Thus, the capping unit 6*b* is moved by the belt 630. The belt 630 is extended along a direction along which the black head unit 50*a* and the color head unit 50*b* are disposed adjacent to each other, and is configured to slidably move the capping unit 6*b* back and forth horizontally, i.e., to the left or right in FIG. 16. The capping unit 6*b* is moved between the home position of FIGS. 16 and 20, where the capping unit 6*b* is not opposite any of the nozzles 51 through 56 of the color head unit 50*b*, and the opposite position of FIGS. 19 and 25 opposite one or more of the nozzles 51 through 56 of the head unit 50*b*. The horizontal position of the capping unit 6*b* is detected by detection sensors S6 through S9 disposed along the path of movement of the fixing member 601. The detection sensor S6 detects the home position where the color capping unit 6*b* is not opposite any of the nozzles of the color head unit 50*b*; the detection sensor S7 detects a fifth opposite position where the color capping unit 6*b* is opposite the nozzles 51 and 52; the detection sensor S8 detects a sixth opposite position where the color capping unit 6*b* is opposite the nozzles 51 through 54; the detection sensor S9 detects a seventh opposite position where the color capping unit 6*b* is opposite the nozzles 51 through 56.

One end 600*a* of the base member 600 is in threaded engagement with one end 610A of a threaded shaft 610 (drive shaft) that extends vertically in FIG. 16. On the other end 610B of the shaft 610, there is fixed a gear 609 which is in meshed engagement with a drive gear 608 rotated by the maintenance movement motor 617D which may include a stepping motor. The drive gear 608, the gear 609, the shaft 610, and the maintenance movement motor 617D constitute the vertical color-cap moving unit 70B.

In the vertical cap moving unit 70B, as the drive gear 608 is rotated by the maintenance movement motor 617D, the shaft 610 rotates via the gear 609, so that the base member 600 can be moved up or down between the capping position and the opposite position. The direction of movement of the base member 600 can be reversed by reversing the direction of rotation of the maintenance movement motor 617D. The opposite position or the capping position may be detected with reference to the number of pulses when the maintenance movement motor 617D comprises a stepping motor. Alternatively, a separate sensor may be provided for detecting the vertical position of the capping unit 6*b*.

Figure 17:
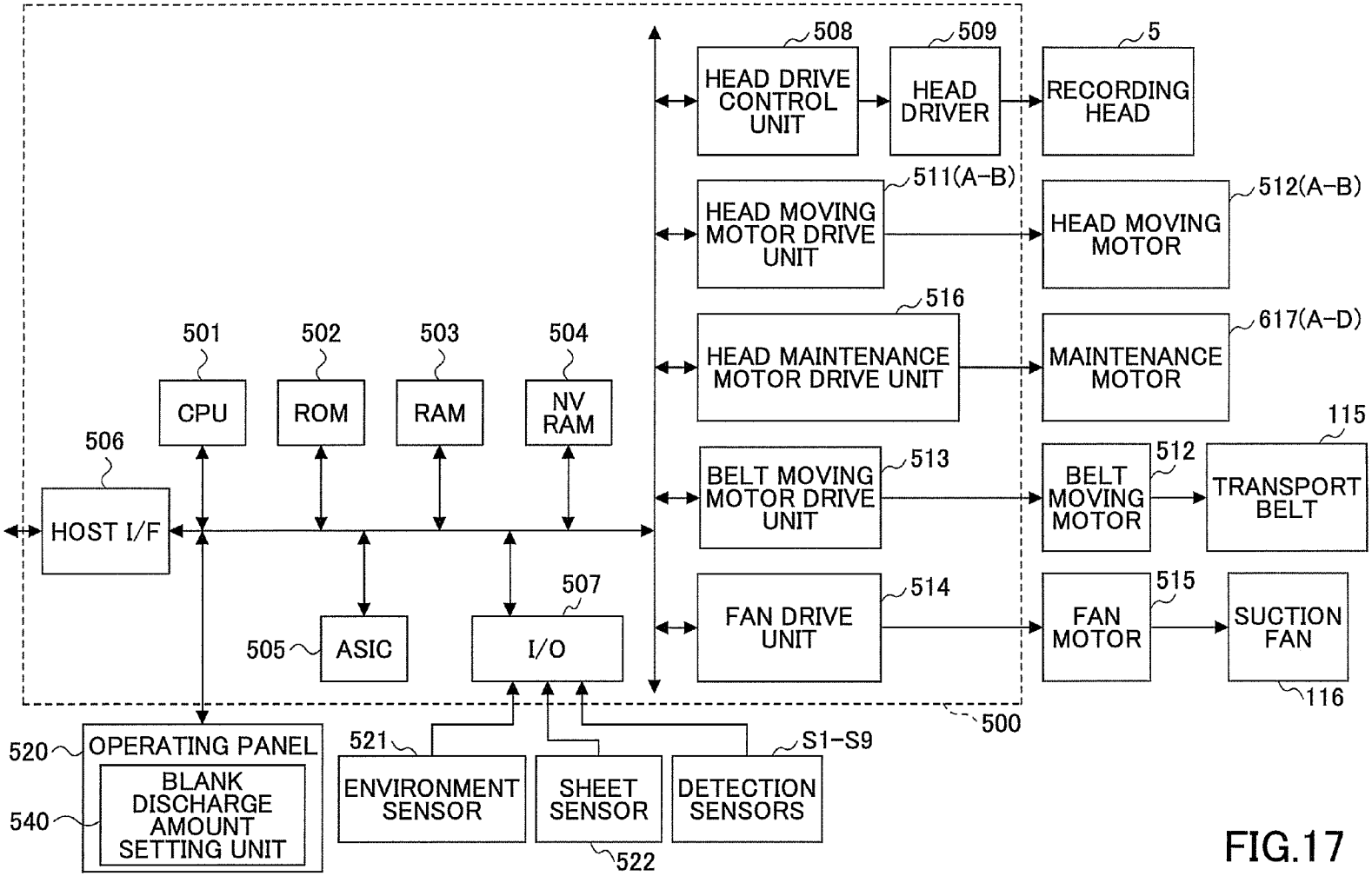
FIG. 17 is a block diagram of the image forming apparatus.

With reference to FIG. 17, the control unit 500 of the image forming apparatus 200 is described. The control unit 500 includes a CPU 501, a ROM 502, a RAM 503, a NVRAM 504 which is a non-volatile memory, and a host interface (I/F) 506. The control unit 500 may be provided by a personal computer. The control unit 500 further includes a head drive control unit 508 and a head driver 509 for controlling an ink discharge operation of the black head unit 50*a* and the color head unit 50*b*. Head drive units 511A and 511B drive head moving motors 512A and 512B for moving the black head unit 50*a* and the color head unit 50*b* vertically up or down. A head maintenance motor drive unit 516 drives maintenance motors 617A through 617D for moving the horizontal cap moving units 60A and 60B and the vertical cap moving units 70A and 70B. A transport belt drive unit 513 drives a belt drive motor 512. A suction motor drive unit 514 drives a suction motor 515 for rotating a fan 44. An I/O port 507 receives detection signals from various sensors including an environment sensor 521 for detecting an ambient temperature and/or an ambient humidity, a sheet sensor 522 for detecting a sheet transport position, and the detection sensors S1 through S9. The control unit 500 is connected to an operating panel 520 for the input and display of information necessary for operating the image forming apparatus 200. The operating panel 520 includes a blank discharge amount setting unit 540 for setting a blank discharge amount for a head recovery operation.

In accordance with the present embodiment, a control sequence table associating the blank discharge amount with humidity is stored in the ROM 502 in advance. During the recovery operation, if the blank discharge amount of ink increases, the ink discharged into the capping/recovery unit 6*a* or the capping unit 6*b* may be scattered in the form of an ink mist, which may stain areas around the caps. Thus, regarding the control of the capping/recovery unit 6*a* and the capping unit 6*b* during the ink blank discharge (nozzle recovery) operation, the ink blank discharge amount can be varied by adjusting a set value T with the blank discharge amount setting unit 540. Specifically, because an ink blank discharge amount exceeding the set value T may lead to staining by the ink mist, a nozzle closing operation (capping) is performed, in which nozzles adjacent to the nozzles of the head unit that discharges ink for blank discharge are capped by the capping/recovery unit 6*a* or the capping unit 6*b*. When the ink blank discharge amount is below the set value T, there is little generation of the ink mist and therefore the problem of staining is unlikely to occur. Thus, in this case, the capping unit 6*b* is controlled such that the cap closing operation (capping) is not performed for the nozzles adjacent to the nozzles of the head unit used for blank discharge.

The set value T is stored in the ROM 502 and may be changed by a user via the blank discharge amount setting unit 540. Alternatively, the set value T may be recorded in the non-volatile memory 504 and may be set through an operation on the operating panel 520 by a user so that the closing operation (capping) can be adjusted during blank discharge.

During a print operation, the CPU 501 reads print data from a reception buffer in the host I/F 506 and analyzes the data, performs a process, such as rearranging the data using the ASIC 505 (the process may be a part of an image process), thus obtaining image data which is transferred to the head drive control unit 508. The print data transferred to the control unit 500 may be obtained by converting image data into bitmap data (print raster data) by a host-side printer driver. Upon reception of the print raster data via the host I/F 506, the head drive control unit 508 sends the dot pattern data (print raster data) to the head driver 509 as serial data in synchronism with a clock signal, and also sends a latch signal to the head driver 509 at a predetermined timing.

The head drive control unit 508 includes a memory (which may be the ROM 502) in which drive waveform (drive signal) pattern data is stored; a waveform generating circuit which may include a D/A converter for D/A converting the drive waveform data read from the ROM; and a drive waveform generating circuit which may include an amplifier. The head driver 509 includes a shift register to which the clock signal and the serial data (image data) from the head drive control unit 508 are input; a latch circuit for latching a register value of the shift register in accordance with a latch signal from the head drive control unit 508; a level conversion circuit (level shifter) for varying the level of an output value from the latch circuit; and an analog switch array that is turned on or off by the level shifter.

By controlling the on- or off-state of the analog switch array, a required drive waveform can be selectively applied to the actuators in the recording head units in the head units 50*a* and 50*b*, thus driving the recording heads and causing the image data to be printed as a dot pattern formed on the sheet. The head drive units 511A and 511B activate the head moving motors 512A and 512B during a print operation or a recovery operation. During a recovery operation (ink blank discharge operation), the head maintenance drive unit 516 drives the maintenance movement motor 617A so that the capping/recovery unit 6*a* is moved to the position opposite the nozzles of the head portion used for the ink blank discharge, and also drives the maintenance movement motors 617C and 617D so that the nozzles adjacent the nozzles used for the ink blank discharge operation are capped by the capping unit 6*b*.

FIG. 18 illustrates a standby status where all of the nozzles 51 through 58 of the head units are closed (capped) by the capping/recovery unit 6*a* and the capping unit 6*b* in a power-saving mode that is activated upon turning on of power or after a period of no-printing status. FIG. 19 illustrates a status of the head units and the capping/recovery unit 6*a* and the capping unit 6*b* during a monochromatic print operation using the black head unit 50*a*. FIG. 20 illustrates a status of the head units and the capping/recovery unit 6*a* and the capping unit 6*b* during a color printing operation involving the black head unit 50*a* and the color head unit 50*b*. The control unit 500 may issue a blank discharge (recovery) instruction in any of the statuses.

When a printing operation is started from the standby status of FIG. 18, the need for a recovery operation may be determined by a stand-by time in which the head units are capped. Specifically, when both the black and color head units 50*a* and 50*b* are capped for more than a predetermined period of time, a recovery operation (such as blank discharge and wiping) needs to be performed for both head units before performing a color print operation in the status of FIG. 20. When a monochromatic print operation is performed in FIG. 19 starting from the standby status of FIG. 18, a recovery operation may be performed for the black head unit 50*a*.

FIG. 19 illustrates the status immediately after the monochromatic print operation. When this is to be followed by a color print operation, if the stand-by (capped) time of the color head unit 50*b* capped by the capping unit 6*b* is more than a preset period of time, nozzle recovery needs to be performed for the color head unit 50*b*. If the head units are left standing for a predetermined period of time, the apparatus 200 enters the power-saving mode, where the black head unit 50*a* is capped by the capping/recovery unit 6*a* as illustrated in FIG. 18. At this stage, the black head unit 50*a* status is immediately after the printing operation and therefore the nozzle surfaces are in a workable state, and therefore there is basically no need for recovery. However, recovery may be required due to a defective discharge (such as "nozzle-down") or periodic maintenance.

FIG. 20 is a status immediately after the color print operation, which transitions to the capping status, i.e., the power-saving mode, of FIG. 18 after the apparatus is left standing for a predetermined period of time. At this stage, the nozzles 51 through 56 of the color head unit 50*b* may be in a dischargeable status requiring no recovery operation because this is immediately after the color print operation. However, recovery of a particular head unit may be required due to discharge failure, such as nozzle-down or for periodic maintenance. In the following, a head recovery operation is described.

Figure 21:
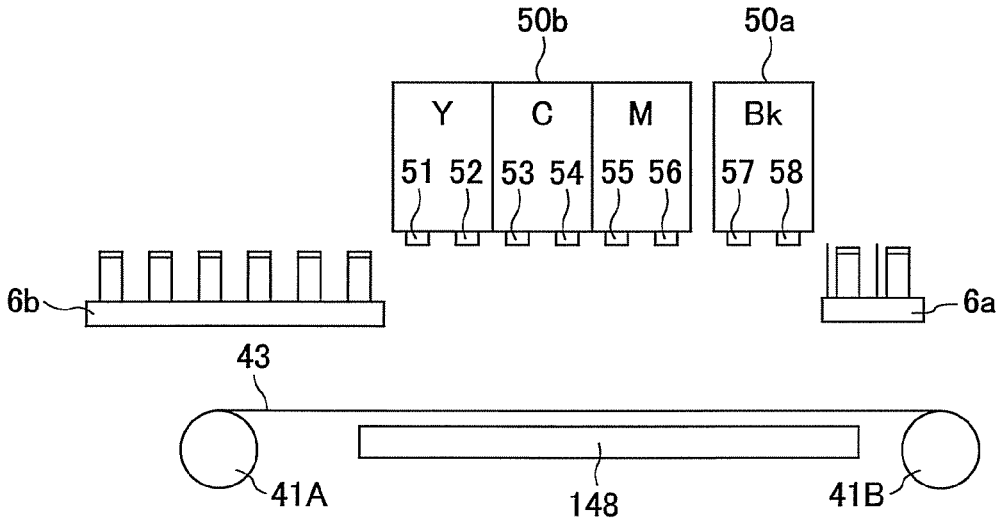
FIG. 21 illustrates the capping units in home positions and the recording head units in a separated position.

FIGS. 21 through 25 illustrate capping operations for ink blank discharge (recovery operation). In FIG. 21, the head units 50*a* and 50*b* are in the separated position and no printing is occurring, where the capping/recovery unit 6*a* and the capping unit 6*b* are removed from the capping status of FIG. 18 and are placed in the respective home positions.

Figure 25:
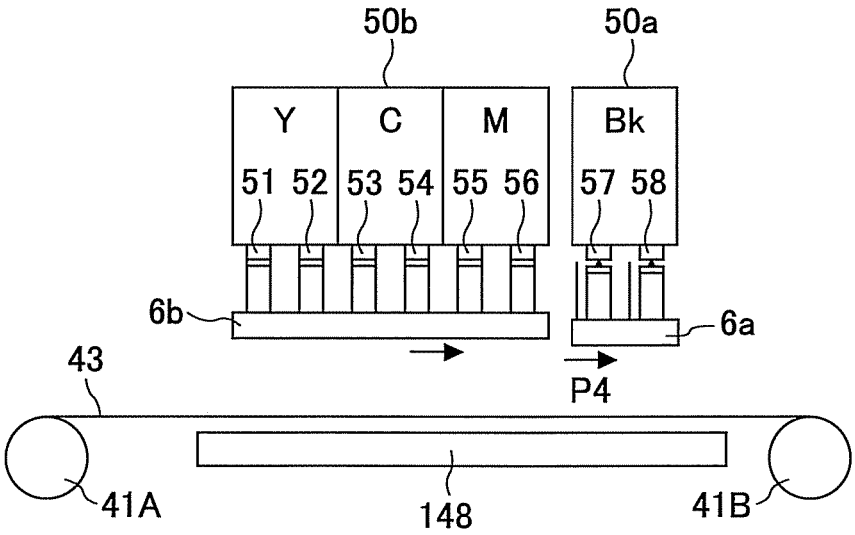
FIG. 25 illustrates a recovery operation for the recording head unit for black.
Figure 26:
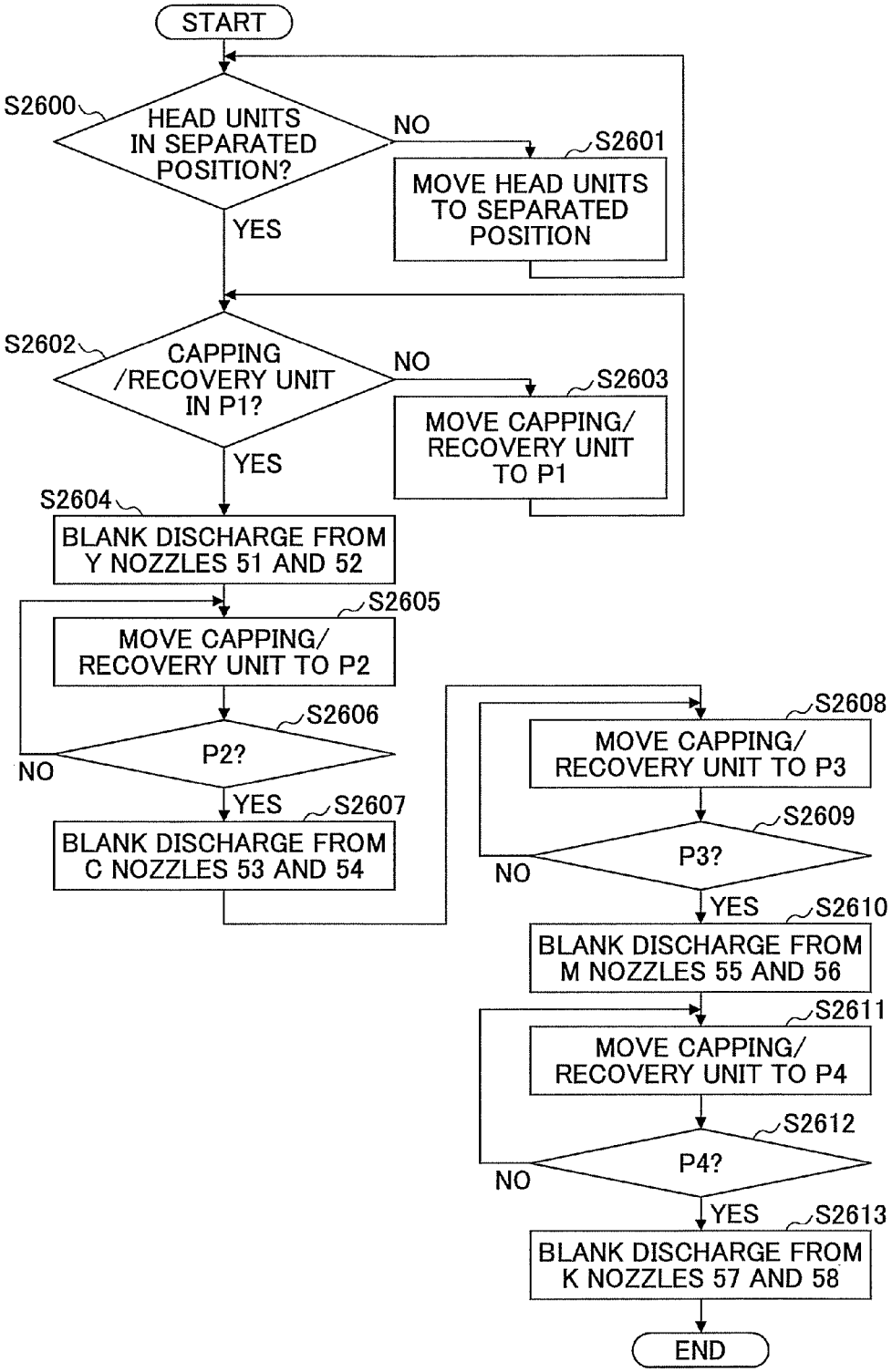
FIG. 26 is a flowchart of a recovery operation for all of the recording head units.

FIG. 26 is a flowchart of a control process performed by the control unit 500 for an ink blank discharge (recovery) operation for all of the colors, i.e., the nozzles 51 through 58, starting from the separated position of the recording head units 50*a* and 50*b*. Reference is also made to FIGS. 21 through 25. At the start of the recovery operation, in step S2600, the control unit 500 determines whether the head units 50*a* and 50*b* are positioned in the separated position of FIG. 21. If not, the head moving motors 512A and 512B are activated in step S2601 so as to move the head units 50*a* and 50*b* to the home position.

Figure 22:
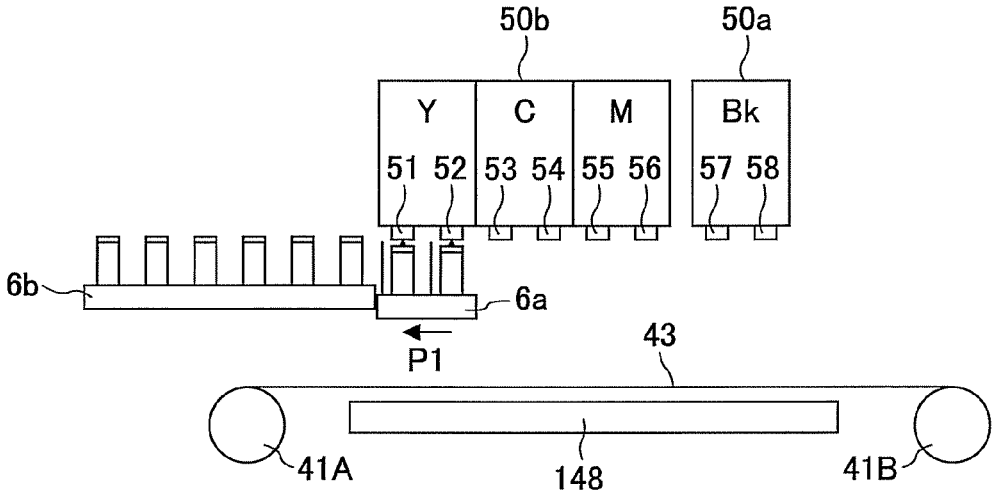
FIG. 22 illustrates a recovery operation for one of the color recording head units.

When the head units 50*a* and 50*b* are in the home positions, it is determined whether the capping/recovery unit 6*a* is positioned in the first opposite position P1 opposite the nozzles 51 and 52 of the head Y as illustrated in FIG. 22, based on the presence or absence of an output from the detection sensor S1 (see FIG. 15). If there is no output from the detection sensor S1 ("NO" in S2602), the maintenance movement motor 617A is rotated so as to move the capping/recovery unit 6*a* to the first opposite position P1 in step S2603. When the capping/recovery unit 6*a* is in the first opposite position P1, an ink blank discharge is performed in the nozzles 51 and 52 (Y) in step S2604.

Figure 23:
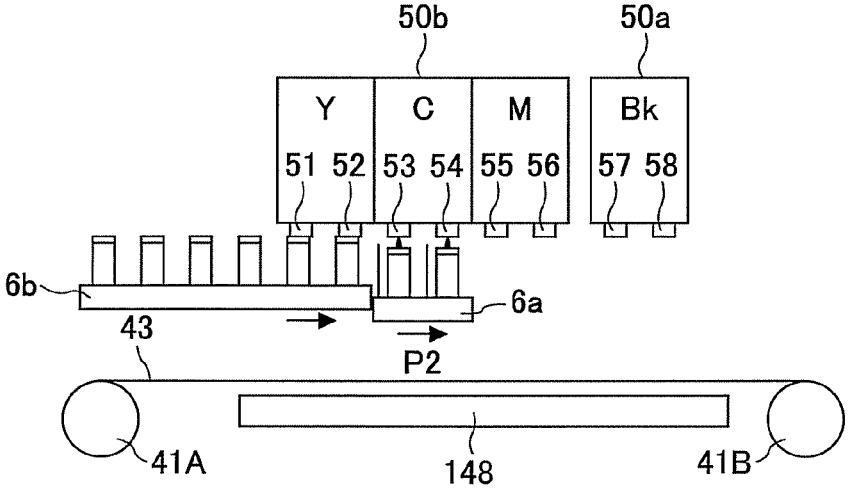
FIG. 23 illustrates a recovery operation for another one of the color recording head units.

Next, in step S2605, the maintenance movement motor 617A is activated such that the capping/recovery unit 6*a* is moved to the second opposite position P2 opposite the nozzles 53 and 54 for cyan C (FIG. 23). At this time, the nozzles 51 and 52 need to be prevented from being stained by the ink mist generated by the ink blank discharge by the nozzles 53 and 54. Thus, the maintenance movement motors 617C and 617D are activated so that the capping unit 6*b* is moved to the position P1 opposite the nozzles 51 and 52, where the capping unit 6*b* is moved up to cap the nozzles 51 and 52.

In step S2606, it is determined whether the capping/recovery unit 6*a* is in the second opposite position P2 and also the nozzles 51 and 52 are capped by the capping unit 6*b*, based on the output from the detection sensors S2 and S7 and the number of steps taken by the maintenance movement motors 617B and 617D, for example. When the caps 6*a* and 6*b* are in the position illustrated in FIG. 23, a recovery operation (ink blank discharge) operation is performed for the nozzles 53 and 54 for cyan C in step S2607.

Figure 24:
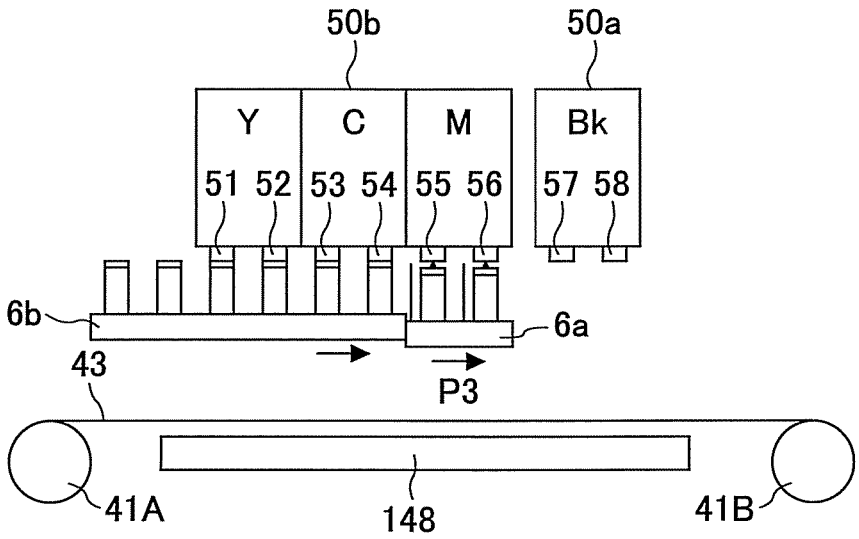
FIG. 24 illustrates a recovery operation for another one of the color recording head units.

In step S2608, as illustrated in FIG. 24, the capping/recovery unit 6*a* is moved to the third opposite position P3 opposite the nozzles 55 and 56 for magenta M by activating the maintenance movement motor 617A. At the same time, the nozzles 51 through 54 (particularly nozzles 53 and 54) need to be prevented from being stained by the ink mist produced by the blank discharge in the nozzles 55 and 56. Thus, the maintenance movement motor 617C is activated so that the nozzles 51 through 54 can be capped by the capping unit 6*b*. In this case, because the capping unit 6*b* is already in the raised (capping) position, the capping unit 6*b* may be laterally moved in a sliding manner by activating only the maintenance movement motor 617C. In this case, however, the capping unit 6*b* may be stained by the ink from the nozzles during the sliding movement. Thus, the capping unit 6*b* may be first lowered from the nozzle capping position by activating the maintenance movement motor 617D, moved to the position opposite the nozzles 51 through 54 by activating the maintenance movement motor 617C, and then moved up so that the nozzles 51 through 54 can be capped by the capping unit 6*b* by controlling the maintenance movement motor 617D.

In step S2609, it is determined whether the capping/recovery unit 6*a* is in the third opposite position P3 and the nozzles 51 through 54 are capped by the color capping unit 6*b*, based on the output from the detection sensors S3 and S8 or the number of steps taken by the maintenance movement motors 617B and 617D. When the capping units 6*a* and 6*b* are in the position illustrated in FIG. 24, a recovery operation (ink blank discharge) is performed for the nozzles 55 and 56 for magenta in step S2610.

In step S2611, the capping/recovery unit 6*a* is moved to the fourth opposite position P4 opposite the nozzles 57 and 58 for black K by activating the maintenance movement motor 617A, as illustrated in FIG. 25. At this time, the nozzles 51 through 56 (particularly nozzles 55 and 56) need to be prevented from being stained by the ink mist produced in the blank discharge from the nozzles 57 and 58. Thus, in order to cap the nozzles 51 through 56 with the capping unit 6*b*, the maintenance movement motor 617C is activated so that the capping unit 6*b* is moved to the position opposite the nozzles 51 through 56. In this case, because the capping unit 6*b* is already in the raised (capping) position, the capping unit 6*b* may be laterally moved in a sliding manner by activating only the maintenance movement motor 617C without activating the maintenance movement motor 617D.

In step S2612, it is determined whether the capping/recovery unit 6*a* is in the fourth opposite position P4 and the capping unit 6*b* is in the capping position capping the nozzles 51 through 56 based on the outputs from the detection sensors S4 and S9 or the number of steps taken by the maintenance movement motors 617B and 617D, for example. Upon detection that the capping/recovery unit 6*a* and the capping unit 6*b* are in the positions illustrated in FIG. 25 based on the detection sensors S4 and S9, for example, a recovery operation (ink blank discharge) is performed for the nozzles 57 and 58 for black K in step S2613, thus completing the head recovery process.

The capping/recovery unit 6*a* may include a suction mechanism and/or a wiping mechanism, so that other recovery operations, such as pressurizing recovery or suction (flow-out) recovery, and wiping, may be performed before the blank discharge operation.

Thus, in accordance with the present embodiment, during the blank discharge operation (recovery operation) for the nozzles of one head, the nozzles of another head, such as the nozzles of an adjacent head for which a recovery operation has already been performed, are capped by the capping unit 6*b*. Thus, the staining of the nozzles of a nearby head by the ink mist produced by the recovery operation for another head unit can be prevented at low cost and without requiring much space.

After the blank discharge operation is performed for all of the nozzles 51 through 58, the head units 50*a* and 50*b* stand by in the print position of FIG. 20. In the case of printing by black alone, the nozzles of the color head unit 50*b* are closed by the capping unit 6*b*, as illustrated in FIG. 19. Alternatively, in the case where, after printing, a recovery operation (blank discharge) is performed for all of the nozzles 51 through 58, the black head unit 50*a* and the color head unit 50*b* may be capped by the capping/recovery unit 6*a* and the capping unit 6*b*, as illustrated in FIG. 18.

Figure 27:
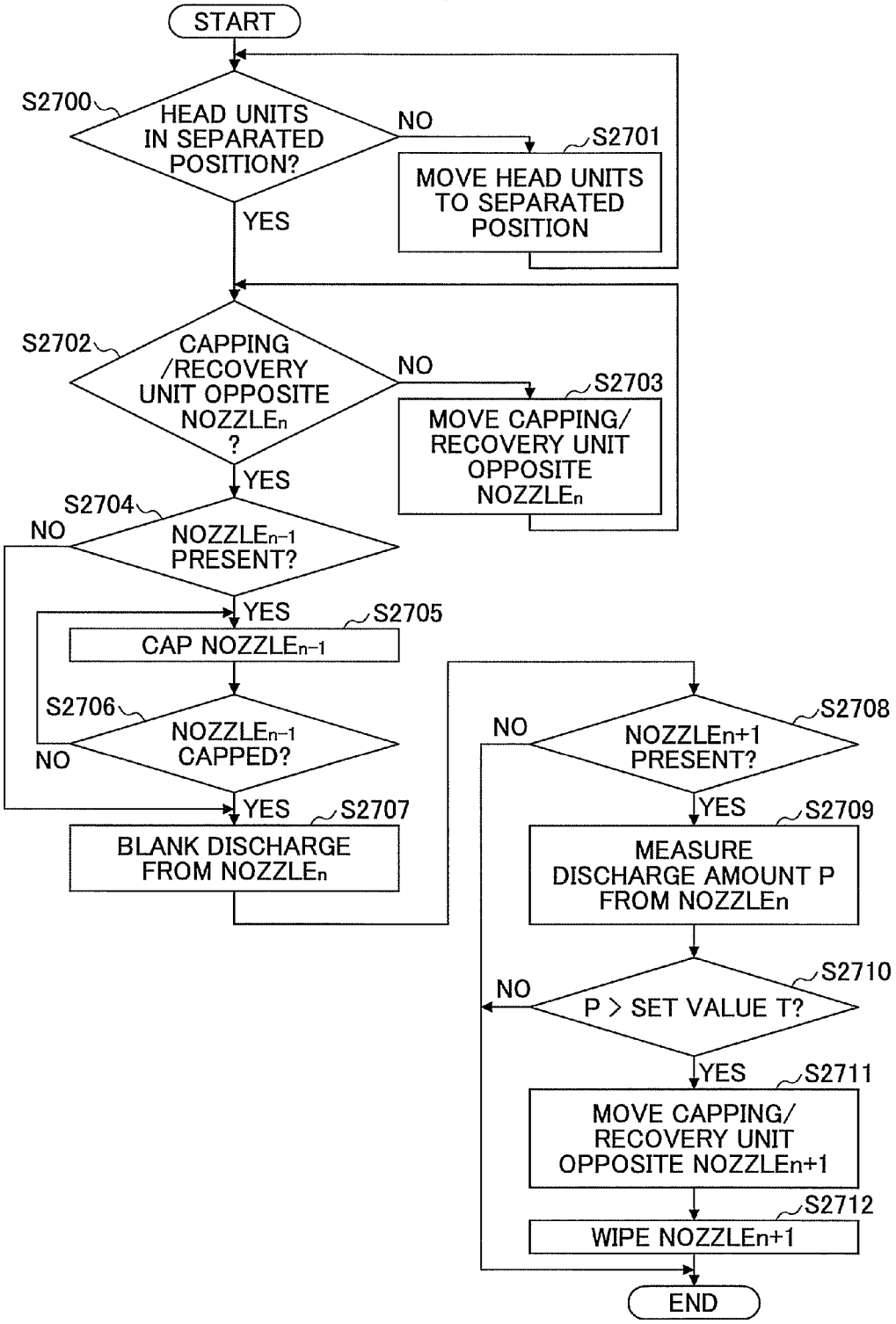
FIG. 27 is a flowchart of a recovery operation for one of the recording head units.

FIG. 27 is a flowchart of a process for performing a blank discharge (nozzle recovery) operation for the nozzles of the recording head for one of a plurality of colors. The nozzles for a given color are referred to as the nozzle$_n$, nozzles adjacent to the right of the nozzle$_n$ are referred to as the nozzle$_{n+1}$, and nozzles adjacent to the left of the nozzle$_n$ are referred to as the nozzle$_{n-1}$. For example, in the case of the color head unit 50*b*, when the nozzle$_n$ corresponds to the nozzles 51 and 52 for yellow, there is no nozzle$_{n-1}$ while the nozzle$_{n+1}$ corresponds to the nozzles 53 and 54 for cyan. When the nozzle$_n$ corresponds to the nozzles 55 and 56 for magenta, the nozzle$_{n-1}$ corresponds to the nozzles 53 and 54 for cyan while the nozzle$_{n+1}$ corresponds to the nozzles 57 and 58 of the black head unit 50*a*.

At the start of the head recovery operation, the control unit 500 determines in step S2700 whether all of the head units are located at the home position (FIG. 21). If not, the head moving motors 512A and 512B are activated in step S2701 so as to move the black and color head units 50*a* and 50*b* to the home positions of FIG. 21. In step S2702, it is determined whether the capping/recovery unit 6*a* is opposite the nozzle$_n$ based on the output of the detection sensors. If not in the opposite position, the relevant maintenance movement motor is activated to move the capping/recovery unit 6*a* to the position opposite the nozzle$_n$ in step S2703.

In step S2704, it is determined whether there is the nozzle$_{n-1}$ (left-adjacent nozzle). If there is, the nozzle$_{n-1}$ is capped by the capping unit 6*b* in step S2705. In step S2706, it is determined whether the nozzle$_{n-1}$ is capped. If capped, the nozzle$_n$ discharges ink into the capping/recovery unit 6*a* for blank discharge (recovery operation) in step S2707.

In step S2708, it is determined whether there is the nozzle$_{n+1}$ (right-adjacent nozzle). If there is the nozzle$_{n+1}$, the amount P of ink blank-discharged from the nozzle$_n$ is measured in step S2709, and it is determined in step S2710 whether the blank discharge amount P from the nozzle$_n$ exceeds a set value T which may be stored in the ROM 502 in advance. The set value T indicates a blank discharge ink amount such that an ink mist will be produced by blank discharge from the nozzle$_n$ and that will adversely affect the adjacent nozzles.

If the set value T is exceeded, ink mist may have already attached onto the adjacent nozzle$_{n+1}$. Thus, the capping/recovery unit 6*a* is moved to the position opposite the nozzle$_{n+1}$ by activating the relevant maintenance movement motor in step S2711, followed by a wiping operation for the nozzle$_{n+1}$ in step S2712. When the blank discharge amount P from the nozzle$_n$ is less than the set value T ("No" in S2710), it is determined that there is no ink mist due to the blank discharge, and therefore the process is completed without performing the wiping process on the nozzle$_{n+1}$.

For example, when the nozzle$_n$ corresponds to the nozzles 51 and 52 for yellow, the nozzles 51 and 52 discharge ink into the capping/recovery unit 6*a* for blank discharge at the cap position P1 of FIG. 22. In this case, because there is no nozzle corresponding to the nozzle$_{n-1}$ ("No" in S2704), no capping operation of the nozzle$_{n-1}$ is performed. When the blank discharge amount P of the nozzles 51 and 52 is equal more than the set value T, the capping/recovery unit 6*a* is moved to the cap position P2 of FIG. 23, where the nozzles 53 and 54 corresponding to the nozzle$_{n+1}$ are wiped by the capping/recovery unit 6*a*.

When the nozzle$_n$ corresponds to the nozzles 57 and 58 of the black head unit 50*a*, an ink blank discharge operation is performed for the nozzles 57 and 58 at the cap position P4 of FIG. 25. In this case, there is the left-adjacent nozzle$_{n-l}$, i.e., the nozzles 55 and 56 ("Yes" in S2704), and the nozzles 55 and 56 are capped by the capping unit 6*b*. Because there is no nozzle$_{n+1}$ to the right of the nozzles 57 and 58 ("No" in S2708), no wiping process of the nozzle$_{n+1}$ is performed.

Figure 28A:
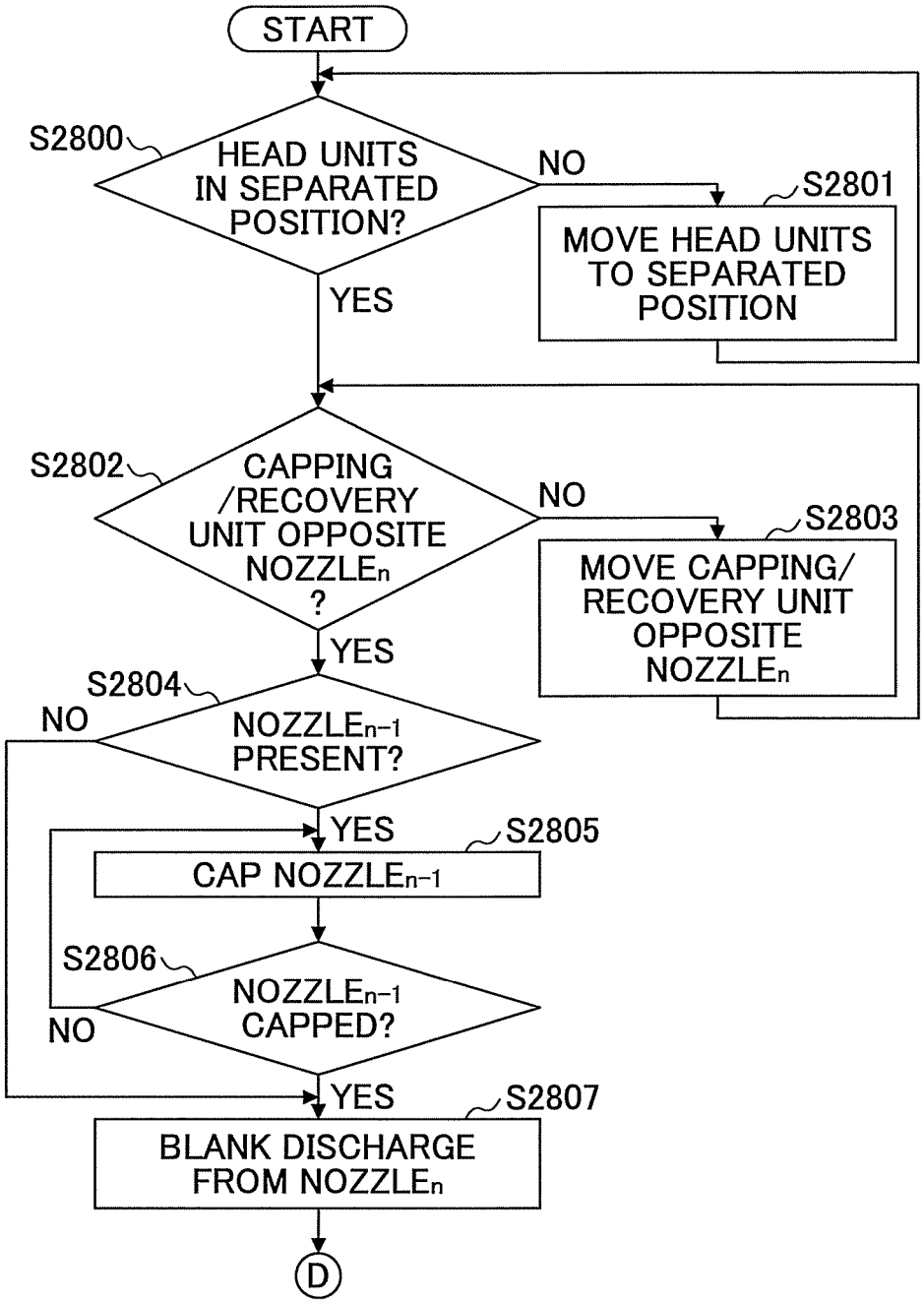
FIGS. 28A and 28B are parts of a flowchart of a recovery operation for two of the recording head units.
Figure 28B:
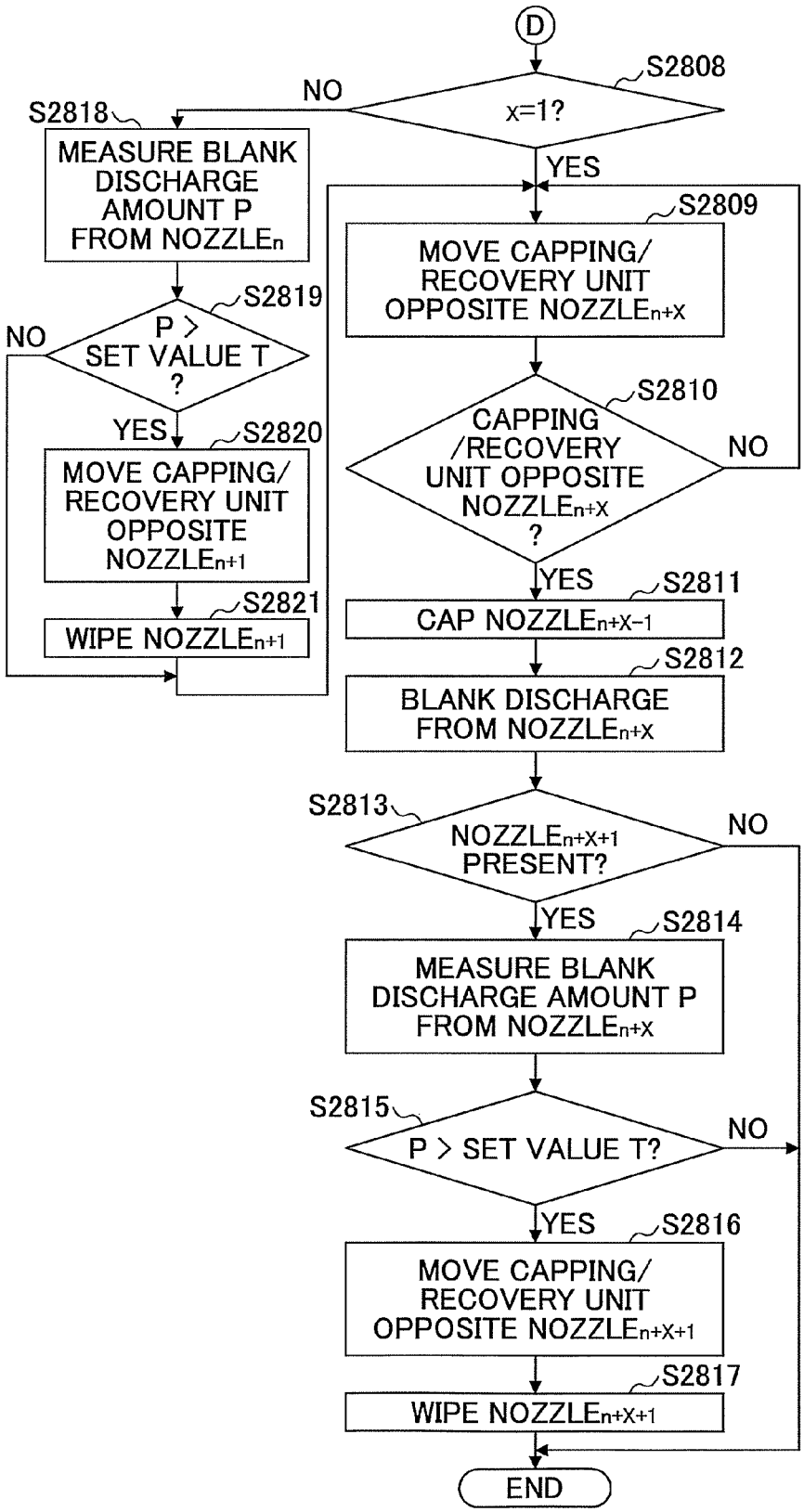

FIGS. 28A and 28B are parts of a flowchart of a recovery operation (blank discharge) involving the nozzles for any two of a plurality of colors. Steps S2800 through S2807 are similar to steps S2700 through S2707 of FIG. 27 for the case of one color and their description is therefore omitted. Thus, the following description is mainly concerned with the blank discharge operation for the other color after a blank discharge operation for the nozzle$_n$. The nozzles of the other color may be the nozzle$_{n+1}$, a nozzle$_{n+2}$, or a nozzle$_{n+3}$.

For example, when the nozzle$_n$ corresponds to the nozzles 51 and 52 for yellow, the nozzle$_{n+1}$ corresponds to the nozzles 53 and 54 for cyan, the nozzle$_{n+2}$ corresponds to the nozzles 55 and 56 for magenta, and the nozzle$_{n+3}$ corresponds to the nozzles 57 and 58 for black. Which nozzles are used for blank discharge may vary depending on the status of use of the apparatus. Thus, the nozzles used for one of the two colors is referred to as the nozzle$_n$, and the nozzles for the second color is referred to as the nozzle$_{n+X}$.

In step S2807 of FIG. 28, the nozzle$_n$ discharges ink for blank discharge (recovery operation). In step S2808, the control unit 500 reads the position of the second nozzle$_{n+x}$, and determines whether X=1, namely, whether the nozzle$_{n+x}$ is adjacent to the nozzle$_n$. If the nozzle$_{n+x}$ is not adjacent to the nozzle$_n$ (No in S2808), it is necessary to determine whether the nozzle$_{n+1}$ is stained by the attachment of ink mist produced by the blank discharge by the nozzle$_n$, prior to performing the blank discharge by the nozzle$_{n+x}$ in step S2812. Thus, if "No" in step S2808, the blank discharge amount P by the nozzle$_n$ is measured in step S2819, and the result of measurement is determined in step S2820. If it is determined in step S2820 that the blank discharge amount P by the nozzle$_n$ is more than the set value T, the adjacent nozzle$_{n+1}$ may be already stained with ink mist. Thus, in step S2821, the capping/recovery unit 6*a* is moved to the position opposite the nozzle$_{n+1}$ by activating the relevant maintenance movement motor, and a wiping operation is performed for the nozzle$_{n+1}$ in step S2822.

If, on the other hand, if X=1 (Yes in S2808), the capping/recovery unit 6*a* is moved to the position opposite the nozzle$_{n+x}$ in step S2809, and it is determined in step S2810 whether the capping/recovery unit 6*a* is in the position opposite the nozzle$_{n+x}$, based on the output of the detection sensors, for example. When the capping/recovery unit 6*a* is in the opposite position, the nozzle$_{n+x-1}$ is closed by the capping unit 6*b*, and then a blank discharge operation is performed for the nozzle$_{n+x}$ in step S2812.

In step S2814, it is determined whether there is the nozzle$_{n+x+1}$. If "Yes", the blank discharge amount P by the nozzle$_{n+x}$ is measured in step S2815. If it is determined in step S2816 that the blank discharge amount P by the nozzle$_{n+x}$ is more than the set value T, the adjacent nozzle$_{n+x+1}$ may be already stained by ink mist by blank discharge by the nozzle$_{n+x}$. Thus, in step S2817, the capping/recovery unit 6*a* is moved to the position opposite the nozzle$_{n+X+1}$ by activating the relevant maintenance movement motor. In step S2818, a wiping operation is performed for the nozzle$_{n+x+1}$, thus completing the process.

For example, when the nozzles 51 and 52 for yellow and the nozzles 55 and 56 for magenta correspond to the two colors for blank discharge, the capping/recovery unit 6*a* is first moved to the position opposite the nozzles 51 and 52 for yellow. Because there is no nozzle$_{n-1}$ to the left of the nozzles 51 and 52, no capping of the nozzle$_{n-1}$ is necessary.

After the blank discharge by the nozzles 51 and 52, blank discharge is performed by the nozzle$_{n+x}$. Because the nozzles 55 and 56 for magenta correspond to X=2, it is determined whether the nozzles 53 and 54 for cyan, i.e., nozzle$_{n+1}$, need to be wiped, based on the blank discharge amount P from the nozzles 51 and 52. When the blank discharge amount is more than the set value T, the nozzles 53 and 54 for cyan may be already stained by ink mist by the blank discharge by the nozzles 51 and 52, and therefore the nozzles 53 and 54 are wiped. After the wiping of the cyan nozzles, the capping/recovery unit 6*a* is moved to the position opposite the nozzles 55 and 56 for magenta, and the nozzles 55 and 56 for magenta are caused to discharge ink for blank discharge with the nozzles 51 through 54 capped by the capping unit 6*b*. After the blank discharge by the nozzles 55 and 56 for magenta, if the blank discharge amount from the nozzles 55 and 56 is more than the set value T, the nozzles 57 and 58 may be stained; therefore, the nozzles 57 and 58 for black are wiped. A blank discharge (recovery) operation may be performed for any three or more of a plurality of colors in a manner similar to the case of the two colors illustrated in FIG. 28.

Although this invention has been described in detail with reference to certain embodiments, variations and modifications exist within the scope and spirit of the invention as described and defined in the following claims.

The present application is based on Japanese Priority Applications No. 2009-291518 filed Dec. 22, 2009 and No. 2010-017331 filed Jan. 28, 2010, the entire contents of which are hereby incorporated by reference.

What is claimed is:

1. An image forming apparatus comprising:

plural color recording heads configured to discharge recording fluids of respective colors and arranged along a sheet transport direction, each recording head having plural nozzles arranged in a nozzle arrangement direction that is perpendicular to the sheet transport direction and configured to discharge droplets of a recording fluid via the nozzles onto a recording sheet in an image forming operation;

a sheet transport unit configured to transport the recording sheet in the sheet transport direction;

a single maintenance unit configured to perform a maintenance operation for the plural color recording heads, the single maintenance unit having a retracting position upstream of the plural color recording heads in the sheet transport direction; and a moving mechanism to move the single maintenance unit (a) in a forward direction that is parallel to the sheet transport direction and that is perpendicular to the nozzle arrangement direction in which the nozzle are arranged, from the retracting position, which is located upstream of a most upstream end of the plural color recording heads in the sheet transport direction, to a blank discharge starting position, which is located opposed to a most downstream end of the plural color recording heads that is the farthest head from the retracting position in the sheet transport direction, and (b) in a backward direction opposite the forward direction, and wherein the single maintenance unit performs the maintenance operation on each of the plural color recording heads by moving the single maintenance unit from the retracting position to the blank discharge starting position in the forward direction without performing the maintenance operation and then moving the single maintenance unit in the backward direction while simultaneously and successively performing the blank discharge from each of the plural color recording heads to the single maintenance unit.

2. The image forming apparatus according to claim 1, further comprising a head drive unit configured to cause the plural color recording heads to discharge the droplets of the recording fluids of respective colors in the image forming operation.

3. The image forming apparatus according to claim 2, wherein the head drive unit is configured to cause the plural color recording heads to perform a preliminary discharge operation in which the plural color recording heads discharge the droplets of the recording fluids of respective colors onto the recording sheet prior to the image forming operation, and wherein, during the preliminary discharge operation, an amount of the droplets of the recording fluid discharged by one recording head of the plural color recording heads located closer to an upstream end of the sheet transport direction is greater than an amount of the droplets of the recording fluid discharged by another recording head of the plural color recording heads located closer to a downstream end of the sheet transport direction.

4. The image forming apparatus according to claim 1, wherein the maintenance unit includes a recording fluid receiving unit configured to receive the droplets of the recording fluid discharged by the recording head.

5. The image forming apparatus according to claim 1, further comprising:

a recording fluid cartridge connected to the recording head and in which the recording fluid is stored; and a pump unit provided between the recording fluid cartridge and the recording head and configured to deliver the recording fluid from the recording fluid cartridge to the recording head, wherein the maintenance unit includes a capping unit configured to cap the nozzle of the recording head in a non-activated period of the recording bead, and wherein the maintenance operation includes a pressure flow-out operation in which the recording fluid is caused to flow out of the nozzle of the recording head into the capping unit using the pump unit.

6. The image forming apparatus according to claim 5, wherein the maintenance operation further includes a blank discharge operation in which the head drive unit causes the recording head to discharge the droplets of the recording fluid into the capping unit for a maintenance purpose when the maintenance unit is moved in the backward direction, wherein the pressured flow-out operation is performed when the maintenance unit is moved in the forward direction.

7. The image forming apparatus according to claim 1, wherein the maintenance unit includes a capping unit configured to cap the nozzle of the recording head in a non-activated period of the recording head, and wherein the maintenance unit includes a suction unit configured to suction the recording fluid out of the nozzle of the cording head into the capping unit in a suction flow-out operation.

8. The image forming apparatus according to claim 7, wherein the maintenance operation includes a blank discharge operation in which the head drive unit causes the recording head to discharge the droplets of the recording fluid into the capping unit for a maintenance purpose when the maintenance unit is moved in the backward direction, wherein the suction flow-out operation is performed when the maintenance unit is moved in the forward direction.

9. The image forming apparatus according to claim 1, wherein the maintenance unit includes a wiping unit configured to wipe the nozzle of the recording head.

10. The image forming apparatus according to claim 5, wherein the maintenance unit includes an ejection channel configured to eject the recording fluid collected in the capping unit out of the capping unit.

11. The image forming apparatus according to claim 1, further comprising:

a maintenance control unit that controls the maintenance unit to perform the maintenance operation sequentially on said each of the plural recording heads, wherein the maintenance control unit applies a first set of control conditions for maintenance of one of the recording heads and applies a second set of control conditions, different from the first set of control conditions, for maintenance of one of the recording heads.

12. The image forming apparatus according to claim 1, wherein the maintenance unit includes a plurality of capping units that are configured to cap the nozzles of the recording heads individually, and when one recording head amongst the recording heads is discharging droplets of the recording fluid via nozzles of the one recording head in a blank discharge operation, the nozzles of another recording head amongst the recording heads are capped by a capping unit amongst the plurality of capping units.

* * * * *